US005960378A

United States Patent [19]

Watanabe et al.

[11] Patent Number: 5,960,378

[45] Date of Patent: Sep. 28, 1999

[54] EXCAVATION AREA SETTING SYSTEM FOR AREA LIMITING EXCAVATION CONTROL IN CONSTRUCTION MACHINES

[75] Inventors: Hiroshi Watanabe; Toichi Hirata, both of Ushiku; Masakazu Haga; Kazuo Fujishima, both of Niihara-gun, all of Japan

[73] Assignee: Hitachi Construction Machinery Co., Ltd., Tokyo, Japan

[21] Appl. No.: 08/776,007

[22] Filed: Jan. 16, 1997

Related U.S. Application Data

[63] Continuation of application No. PCT/JP96/02251, Aug. 8, 1996.

[30] Foreign Application Priority Data

Aug. 14, 1995 [JP] Japan ..... 7-207023

[51] Int. Cl.[6] ..... E02F 9/00; E02F 3/43

[52] U.S. Cl. ..... 702/150; 37/415; 37/416

[58] Field of Search ..... 364/559, 561, 364/562, 556, 140.02, 167.07, 172; 37/347, 348, 411, 415, 416, 443; 172/4.5; 356/4.08, 4, 27; 56/10.2 R, 10.2 D, 10.2 E; 73/1.81, 1.79, 65.01; 702/150, 152, 94

[56] References Cited

U.S. PATENT DOCUMENTS

| | | | |
|---|---|---|---|
| 3,997,071 | 12/1976 | Teach | 214/761 |
| 4,129,224 | 12/1978 | Teach | 214/763 |
| 4,231,700 | 11/1980 | Studebaker | 414/700 |
| 4,288,196 | 9/1981 | Sutton, II | 414/699 |
| 4,393,606 | 7/1983 | Warnecke | 37/103 |
| 4,452,078 | 6/1984 | Formanek et al. | 73/432 HA |
| 4,491,927 | 1/1985 | Bachmann et al. | 364/561 |
| 4,650,393 | 3/1987 | Denda | 414/694 |
| 4,679,336 | 7/1987 | Brocklebank et al. | 37/103 |
| 4,726,682 | 2/1988 | Harms et al. | 356/375 |
| 4,807,131 | 2/1989 | Clegg | 364/424.01 |
| 4,829,418 | 5/1989 | Nielsen | 364/167.01 |
| 4,866,641 | 9/1989 | Nielsen et al. | 364/559 |
| 4,884,939 | 12/1989 | Nielsen | 414/698 |
| 4,888,890 | 12/1989 | Studebaker et al. | 37/103 |
| 4,889,466 | 12/1989 | Jindai et al. | 414/694 |
| 5,189,484 | 2/1993 | Koschmann et al. | 356/138 |
| 5,438,771 | 8/1995 | Sahm et al. | 37/348 |
| 5,572,809 | 11/1996 | Steenwyk et al. | 37/348 |
| 5,666,202 | 9/1997 | Kyrazis | 356/375 |
| 5,671,554 | 9/1997 | Geelhoad | 37/348 |
| 5,682,311 | 10/1997 | Clark | 364/424.07 |

FOREIGN PATENT DOCUMENTS

| | | | |
|---|---|---|---|
| 0 707 118 | 4/1996 | European Pat. Off. | E02F 3/43 |
| 0 711 876 | 5/1996 | European Pat. Off. | E02F 3/42 |
| 63-219731 | 9/1988 | Japan . | |
| 3-295933 | 12/1991 | Japan . | |
| 4-136324 | 5/1992 | Japan . | |

*Primary Examiner*—Patrick Assouad
*Attorney, Agent, or Firm*—Fay, Sharpe, Beall, Fagan, Minnich & McKee

[57] ABSTRACT

An excavation area setting system for area limiting excavation control in construction machines, with the excavation control being performed to calculate a target speed vector for control of a front device on the basis of a body, modify the target speed vector to limit a moving speed of the front device in the direction toward a boundary of a preset excavation area when the front device comes close to the boundary of the excavation area, and move the front device along the boundary of the excavation area. To set the excavation area, an external reference is installed horizontally outside the hydraulic excavator and a depth from the external reference to the boundary of the excavation area is set by using a setting device. The excavation area is set in a manner matched with the excavation control in which calculation is executed based on the position of the body.

6 Claims, 18 Drawing Sheets

EXCAVATION AREA SETTING SYSTEM FOR AREA LIMITING EXCAVATION CONTROL IN CONSTRUCTION MACHINES

This application is a continuation of PCT/JP96/02251 filed Aug. 8, 1996.

TECHNICAL FIELD

The present invention relates to an area limiting excavation control in construction machines, and more particularly to an excavation area setting system for area limiting excavation control with which a construction machine such as a hydraulic excavator including a multi-articulated front device can perform excavation while limiting an area where the front device is movable.

BACKGROUND ART

A hydraulic excavator is a known, typical construction machine. A hydraulic excavator is made up of a front device comprising a boom, an arm and a bucket which are each pivotable in the vertical direction, and a body comprising an upper structure and an undercarriage. The boom of the front device is supported at its base end by a front portion of the upper structure. Such a hydraulic excavator has a feature that the front device is movable in a wide range. This feature is convenient from the working point of view on one side, but, on the other side, requires an operator to carefully perform operation when the hydraulic excavator is used in work where the ground is to be excavated into a particular configuration and the front device should be prevented from projecting excessively. In view of the above, it is proposed to limit a workable area of the front device as disclosed in JP-A-4-136324, for example. As a method of setting an area limit (entrance forbidden area), JP-A-4-136324 discloses a method of moving a tip end of a front device (bucket prong) to the area limit (entrance forbidden area) and memorizing the position of the area limit, or entering the area limit in terms of numerical values from a control panel.

Further, in a hydraulic excavator, front members such as a boom are operated by respective manual control levers. However, because the front members are coupled to each other through articulations for pivoting motion, it is very difficult to carry out excavation work over a predetermined area, particularly an area set by linear lines, by operating the front members. For this reason, there is a demand for enabling such work to be performed in an automatic manner. When a hydraulic excavator is designed to have a function of automating such work, the posture and height of the hydraulic excavator itself are varied due to change in topography of the work site if a body of the excavator is moved. This means that the area set with respect to the body must be set again whenever the body is moved. In view of the above, JP-A-3-295933 proposes an automatic excavation method for facilitating work to be performed within a limited area. The proposed automatic excavation method comprises the steps of detecting a height of an excavator body by a sensor, which is mounted on the body, using a laser beam from a laser oscillator installed on the ground to be excavated, determining an excavation depth (corresponding to an area limit in the above related art) based on the detected height of the body, excavating the ground linearly over a predetermined length while the body is kept stopped, then traveling the body by a predetermined distance, detecting change in height of the body by using the laser beam when excavating the ground linearly again while the body is kept stopped, and modifying the excavation depth in accordance with the detected change in the body height.

Also, U.S. Pat. No. 4,829,418 proposes another automatic excavation method adapted for excavating a linear set area by using a laser beam. This proposed automatic excavation method comprises the steps of setting a desired excavation depth (HTTRGT) with a laser beam as a basis, mounting a laser sensor on an arm, calculating a distance (HTACT) from the laser beam to a bucket prong of a front device at the moment the laser sensor detects the laser beam during excavation, and controlling associated actuators in accordance with a result of comparison between HTTRGT and HTACT so that the bucket prong is moved near the desired excavation depth.

However, the foregoing related arts have problems as follows.

First, with the related art disclosed in JP-A-4-136324, because of an area limit (entrance forbidden area) being set with the body as a basis, if the posture and height of the hydraulic excavator itself are varied due to a change in topography of the work site upon movement of the body, the set depth of the area limit is also varied correspondingly. For example, if the ground surface is inclined, the set depth is changed following a slope of the ground surface with movement of the body and thus the set plane of the area limit is also inclined.

Next, with the related art disclosed in JP-A-3-295933, change in the vehicle height upon movement of the body can be compensated. However, since the excavation depth is set with the body as a basis when it is set from a control panel, manufacturing tolerances of the body or tolerances in accuracy and mounting of angle sensors for measuring a position and posture of the front device for use in control are accumulated as errors when a bucket tip position is calculated in excavation control, and a depth at which the ground is actually excavated is not in agreement with the set excavation depth. Accordingly, excavation cannot be performed as per setting.

Also, since the excavation depth from the body is changed if the body height is changed with movement of the body, resulting change in the excavation depth is also affected by errors of the sensors for measuring a position and posture of the front device, and the excavation depth becomes different between before and after the body height is varied.

Further, in order that the laser beam surely impinges upon the sensor for detection thereof even with the body height changed, many sensors require to be mounted on the body side by side in the height direction, resulting in a large-sized and complicated sensor equipment.

Additionally, since the body height is compensated by using the sensor mounted on the body, the body height capable of being compensated is limited in accordance with restriction imposed from the sensor size.

The related art proposed by U.S. Pat. No. 4,829,418 can solve the problems of the foregoing related arts disclosed in JP-A-4-136324 and JP-A-3-295933 to some degree. With the related art proposed by U.S. Pat. No. 4,829,418, however, since the excavation depth is set with the laser beam as a basis, there arises a problem that the proposed automatic excavation method is not suitable for use in excavation control where calculation necessary for control is made with the body as a basis, e.g., area limiting excavation control proposed by the inventors of this application as an international application numbered PCT/JP95/00843, and reliability of control cannot be ensured.

More specifically, the inventors of this application have proposed, in the international application numbered PCT/JP95/00843, an area limiting excavation control system wherein a target speed vector for control of a front device is calculated with a body as a basis, and when the front device comes close to a boundary of a preset excavation area, a moving speed of the front device in the direction toward the boundary is restricted by modifying the calculated target speed vector, so that the front device is moved along the boundary. Since such area limiting excavation control requires various control variables relating to the target speed vector to be calculated with the body as a basis, setting data for an excavation area, which is set with the laser beam as a basis like U.S. Pat. No. 4,829,418, cannot be directly employed. Therefore, it is required to modify the setting data on the basis of the laser beam to be usable in calculation on the basis of the body. However, a controller has a limit on its memory capacity and a calculation time is prolonged with more complicated calculation. In particular, if the complicated calculation is executed during excavation control, there occurs a delay in the control process and the bucket tip may go out of the boundary of the set area.

SUMMARY OF THE INVENTION

A first object of the present invention is to provide an excavation area setting system for area limiting excavation control in construction machines with which setting of an excavation area is not changed even when the body height is changed upon movement of a body.

A second object of the present invention is to provide an excavation area setting system for area limiting excavation control in construction machines with which the effect of errors such as manufacturing tolerances of the body or tolerances in accuracy and mounting of angle sensors for measuring a position and posture of a front device for use in control are reduced, and hence excavation can be performed with a less difference from the set excavation area.

A third object of the present invention is to provide an excavation area setting system for area limiting excavation control in construction machines with which setting of an excavation area is not changed even when the body height is changed upon movement of a body, and change in excavation depth caused by the effect of errors in angle sensors for measuring a position and posture of a front device is small.

A fourth object of the present invention is to provide an excavation area setting system for area limiting excavation control in construction machines with which movement of a body can be compensated without needing a large-sized and complicated sensor.

A fifth object of the present invention is to provide an excavation area setting system for area limiting excavation control in construction machines with which movement of a body can be compensated in a wide range.

A sixth object of the present invention is to provide an excavation area setting system for area limiting excavation control in construction machines with which setting of an excavation area suitable for excavation control where calculation is made with a body as a basis can be achieved and reliability of excavation control can be ensured.

(1) To achieve the above first to sixth objects, an excavation area setting system for area limiting excavation control in construction machines according to the present invention is constructed as follows. In an excavation area setting system for area limiting excavation control in construction machines comprising a plurality of vertically pivotable front members making up a multi-articulated front device, and a body for supporting the front device, the excavation control being performed to calculate a target speed vector for control of the front device on the basis of the body, modify the target speed vector to limit a moving speed of the front device in the direction toward a boundary of a preset excavation area when the front device comes close to the boundary of the excavation area, and move the front device along the boundary of the excavation area, the excavation area setting system comprising (a) an external reference member installed outside the construction machine and providing an external reference serving as a reference position for the excavation area; (b) a front reference member disposed on the front device and providing a front reference serving as a target used for aligning the front device with the external reference; (c) detecting means for detecting status variables in relation to a position and posture of the front device; (d) first calculating means for calculating the position and posture of the front device on the basis of the body from signals of the detecting means; (e) first setting means for setting the excavation area from a positional relationship with respect to the external reference; (f) second calculating means for calculating a positional relationship between the body and the external reference based on information about the position and posture of the front device calculated by the first calculating means when the front reference is aligned with the external reference, and calculating a positional relationship between the body and the excavation area from the positional relationship between the body and the external reference and the positional relationship between the external reference and the excavation area set by the first setting means; and (g) second setting means for setting an excavation area on the basis of the body from the positional relationship between the body and the excavation area calculated by said second calculating means.

In the present invention constructed as set forth above, when the front reference is aligned with the external reference, the second calculating means modifies the positional relationship between the external reference and the excavation area set by the first setting means to calculate the positional relationship between the body and the excavation area, and the second setting means sets the excavation area on the basis of the body. Therefore, the operator can perform excavation work while compensating change in the body height caused by movement of the body whenever it occurs. As a result, even when the body height is changed upon movement of the body, the setting of the excavation area remains the same, enabling excavation work to be always carried out at a predetermined depth on the basis of the external reference.

Further, the front reference member is disposed on the front device actually acting on the ground, and the excavation area on the basis of the body is set from the position and posture of the front device which results when the front reference is aligned with the external reference. Therefore, the effect of errors, such as manufacturing tolerances of the body or tolerances in accuracy and mounting of the front reference, the detection means, etc., upon the setting of the excavation area is offset through the calculation for setting the excavation area and the calculation for the excavation control. Accordingly, when the position of the front device is calculated in the excavation control, a calculation result is less affected by the above-mentioned tolerances and other errors in accuracy than the conventional method of detecting reference light by a sensor mounted on the body, and excavation can be precisely performed as per the setting with a smaller difference from the set excavation area.

Because of the setting being less affected by the errors of the detecting means for measuring the position and posture of the front device, even when the excavation depth from the body is changed due to change in the body height with movement of the body, the effect of the errors of the detecting means upon the change amount of the excavation depth is so small as to prevent change in the excavation depth between before and after the body height is varied.

Since the modification of the positional relationship by the second calculating means is effected when the front reference is aligned with the external reference by moving the front device, the movement of the body can be compensated by providing the front reference member, which may be formed of a small and simple member, on the front device.

Similarly, since the modification of the positional relationship by the second calculating means is effected by moving the front device to make the front reference aligned with the external reference, the movement of the body can be compensated over a wide range from the fact that the front device is movable over a wide range.

In the area limiting excavation control for which the present invention is employed, since the target speed vector for control of the front device is calculated on the basis of the body and the movement of the front device is controlled by modifying the target speed vector, it is required to calculate various variables relating to the target speed vector on the basis of the body during the excavation control. In the setting system of the present invention, the second calculating means and the second setting means are provided in addition to the first setting means, the second setting means calculates the positional relationship between the body and the excavation area by modifying the positional relationship between the external reference and the excavation area which has been set by the first setting means, and the second setting means sets the excavation area on the basis of the body as with the excavation control. Therefore, the setting data of the excavation area determined by the second setting means can be employed as it is for calculation in the excavation control and thus the calculation in the excavation control can be simplified. As a result, necessary calculation can be executed in a moment with a restricted memory capacity and highly reliable area limiting excavation control can be achieved without causing a delay.

(2) In the above (1), the excavation area setting system preferably further comprises an external reference setting switch depressed when the front reference is aligned with the external reference, and the second calculating means performs the calculation when the external reference setting switch is depressed.

With this feature, it is possible to set the excavation area on the basis of the body by the second calculating means in advance, by moving the front device and depressing the external reference setting switch when the front reference is aligned with the external reference, prior to starting work under the excavation control. Therefore, the calculation for setting the excavation area is not required during the excavation control and the amount of calculation to be executed during the excavation control is reduced, resulting in more highly reliable area limiting excavation control with more positive prevention of a delay.

(3) In the above (1) or (2), preferably, the first setting means is a means for setting a depth from the external reference to the boundary between the excavation area and a forbidden area. By so constructing the first setting means, an excavation area having a horizontal plane at the boundary between it and the forbidden area can be set.

(4) In the above (1) or (2), preferably, the first setting means may be means for setting a depth from the external reference to a reference point of the excavation area, a distance from the body to the reference point, and a tilting angle of the boundary of the excavation area. By so constructing the first setting means, a sloped excavation area can be set.

(5) In the above (1) or (2), preferably, the first setting means is a means for setting the positional relationship between the external reference and the excavation area based on data input from a setting device. With this feature, by effecting the setting operation of the first setting means thus constructed prior to starting work, no assistant operator is necessary to position the front device to the boundary of the excavation area at the start of work or whenever the body is travelled to a different place. Further, a time required for making the setting in accordance with an instruction from the assistant operator can be eliminated and a working time can be cut down.

(6) In the above (1) or (2), preferably, the first setting means may include means for calculating a position of a tip end of the front device taken when the front device is moved and the tip end of the front device comes to the boundary of the set area, based on information about the position and posture of the front device calculated by the first calculating means, means for calculating a position of the front reference taken when the front device is moved and the front reference is aligned with the external reference, based on the information about the position and posture of the front device calculated by the first calculating means, and means for calculating and storing a positional relationship between the external reference and the excavation area from the position of the tip end of the front device and the position of the front reference. By so constructing the first setting means, the positional relationship between the external reference and the excavation area is calculated and stored based on the position of the tip end of the front device taken when the tip end of the front device comes to the boundary of the set area, and the position of the front reference taken when the front reference is aligned with the external reference. It is therefore possible to set the excavation area by direct teaching and to precisely set a desired excavation area depending on work situations.

BEST MODE FOR CARRYING OUT THE INVENTION

Hereinafter, embodiments of the present invention will be described with reference to the drawings.

A first embodiment of the present invention will be first explained with reference to FIGS. 1 to 11.

Figure 1:
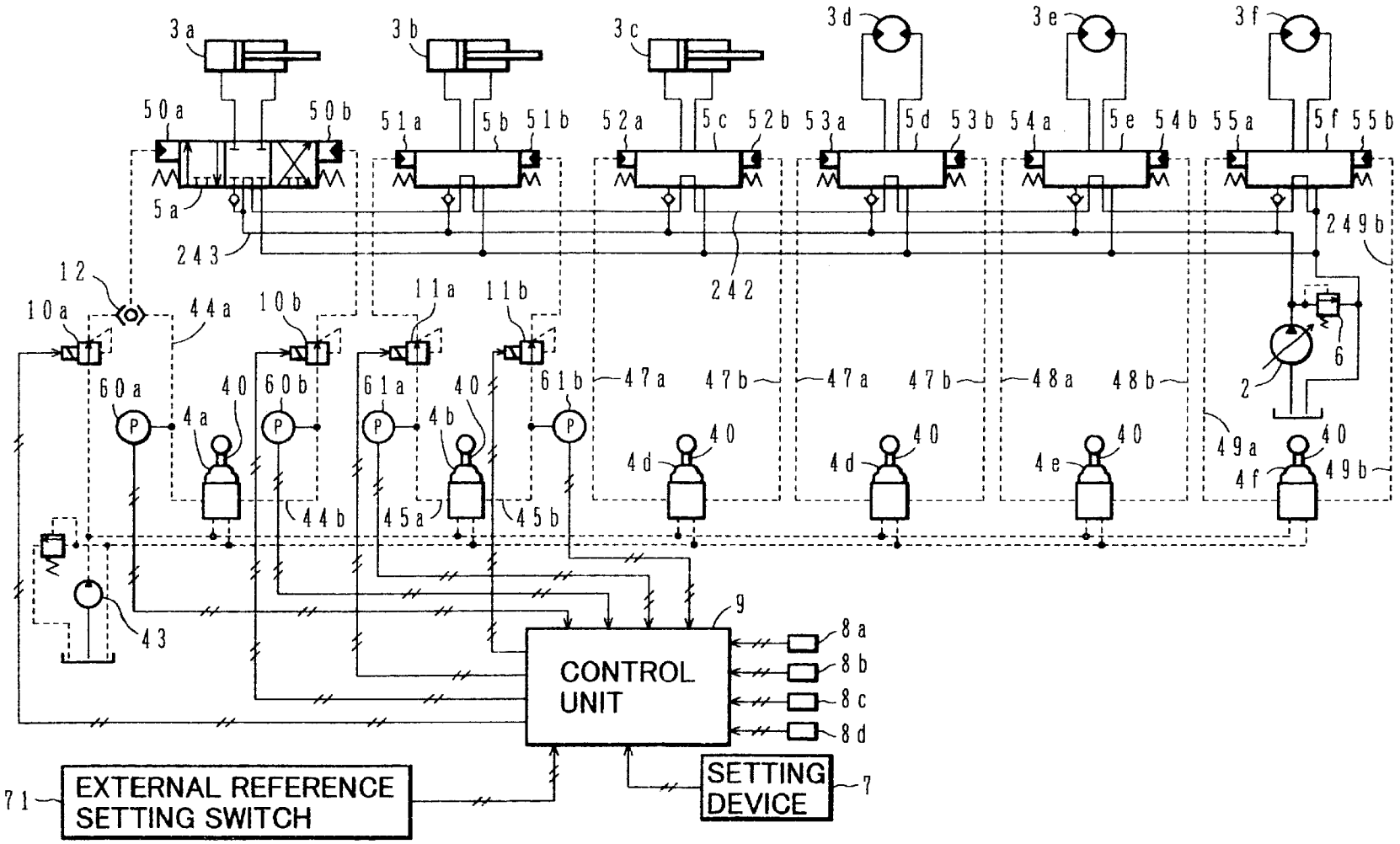
FIG. 1 is a diagram showing an area limiting excavation control system for construction machines equipped with an excavation area setting system according to a first embodiment of the present invention, along with a hydraulic drive system.

In FIG. 1, a hydraulic excavator to which the present invention is applied comprises a hydraulic pump 2, a plurality of hydraulic actuators driven by a hydraulic fluid from the hydraulic pump 2, including a boom cylinder 3*a*, an arm cylinder 3*b*, a bucket cylinder 3*c*, a swing motor 3*d* and left and right track motors 3*e*, 3*f*, a plurality of control lever units 4*a*–4*f* provided respectively corresponding to the hydraulic actuators 3*a*–3*f*, a plurality of flow control valves 5*a*–5*f* connected between the hydraulic pump 2 and the plurality of hydraulic actuators 3*a*–3*f* for controlling respective flow rates of the hydraulic fluid supplied to the hydraulic actuators 3*a*–3*f*, and a relief valve 6 which is opened when the pressure between the hydraulic pump 2 and the flow control valves 5*a*–5*f* exceeds a preset value. The above components cooperatively make up a hydraulic drive system for driving driven members of the hydraulic excavator.

Figure 2:
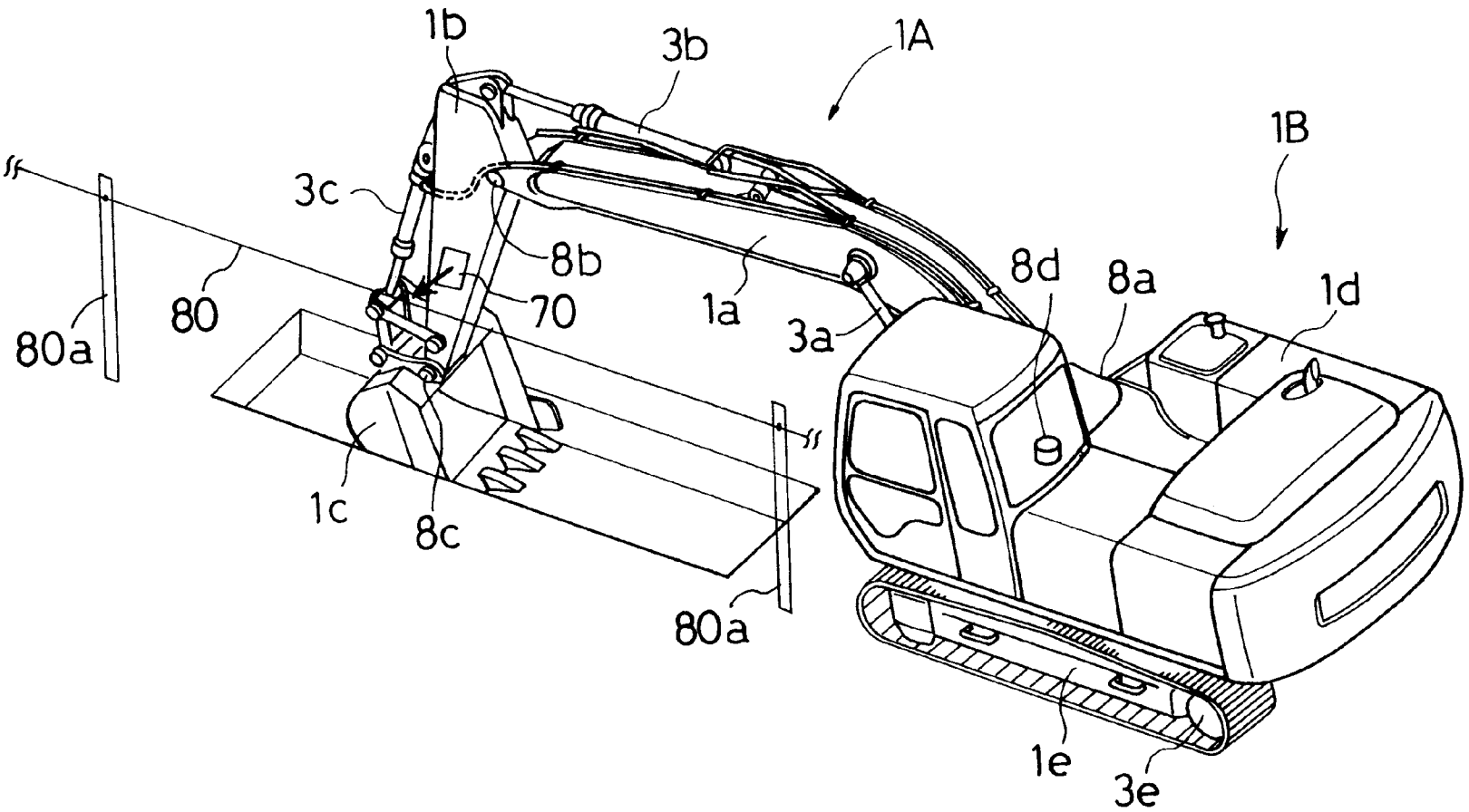
FIG. 2 is a view illustrating a hydraulic excavator to which the present invention is applied, and a shape of a set area around the excavator.

As shown in FIG. 2, the hydraulic excavator is made up of a multi-articulated front device 1A comprising a boom 1*a*, an arm 1*b* and a bucket 1*c* which are each pivotable in the vertical direction, and a body 1B comprising an upper structure 1*d* and an undercarriage 1*e*. The boom 1*a* of the front device 1A is supported at its base end to a front portion of the upper structure 1*d*. The boom 1*a*, the arm 1*b*, the bucket 1*c*, the upper structure 1*d* and the undercarriage 1*e* serve as driven members which are driven respectively by the boom cylinder 3*a*, the arm cylinder 3*b*, the bucket cylinder 3*c*, the swing motor 3*d* and the left and right track motors 3*e*, 3*f*. These driven members are operated in accordance with instructions from the control lever units 4*a* to 4*f*.

Returning to FIG. 1, the control lever units 4*a*–4*f* are each of a hydraulic pilot type driving a corresponding one of the flow control valves 5*a* to 5*f* with a pilot pressure. Each of the control lever units 4*a*–4*f* comprises a control lever 40 manipulated by the operator, and a pair of pressure reducing valves (not shown) for generating a pilot pressure depending on the input amount and the direction by and in which the control lever 40 is manipulated. The pressure reducing valves are connected at primary ports to a pilot pump 43, and at secondary ports to corresponding ones of hydraulic driving sectors 50*a*, 50*b*; 51*a*, 51*b*; 52*a*, 52*b*; 53*a*, 53*b*; 54*a*, 54*b*; 55*a*, 55*b* of the flow control valves through pilot lines 44*a*, 44*b*; 45*a*, 45*b*; 46*a*, 46*b*; 47*a*, 47*b*; 48*a*, 48*b*; 49*a*, 49*b*.

An area limiting excavation control system including an excavation area setting system of this embodiment is equipped in the hydraulic excavator constructed as explained above. The control system comprises a setting device 7 for providing an instruction to set an excavation area where a predetermined part of the front device, e.g., a tip of the bucket 1*c*, is movable, depending on the scheduled work beforehand, angle sensors 8*a*, 8*b*, 8*c* disposed respectively at pivot points of the boom 1*a*, the arm 1*b* and the bucket 1*c* for detecting respective rotational angles thereof as status variables in relation to the position and posture of the front device 1A, a tilting sensor 8*d* for detecting a tilting angle θ of the body 1B in the forth-and-back direction, pressure sensors 60*a*, 60*b*; 61*a*, 61*b* disposed in the pilot lines 44*a*, 44*b*; 45*a*, 45*b* connected to the boom and arm control lever units 4*a*, 4*b* for detecting respective pilot pressures input from the control lever units 4*a*, 4*b*, an external reference member 80 (see FIG. 2; "external reference member" referred to also as "external reference" hereinafter) installed outside the hydraulic excavator for providing an external reference indicative of a reference position with respect to the excavation area, a front reference member 70 (see FIG. 2; "front reference member" referred to also as "front reference" hereinafter) attached on a side of the arm 1*b* of the front device 1A for providing a front reference as a target based on which the front device 1A is calibrated to the external reference, an external reference setting switch 71 depressed when the front reference 70 is made aligned with the external reference 80 through operation of the front device 1A, a control unit 9 for receiving a setup signal of the setting device 7, detection signals of the angle sensors 8*a*, 8*b*, 8*c* and the tilting sensor 8*d*, detection signals of the pressure sensors 60*a*, 60*b*; 61*a*, 61*b* and an input signal of the external reference setting switch 71, setting an excavation area where the tip of the bucket 1*c* is movable, and out-putting electric signals to perform excavation control within the limited area, proportional solenoid valves 10*a*, 10*b*, 11*a*, 11*b* driven by the electric signals output from the control unit 9, and a shuttle valve 12. The shuttle valve 12 is disposed in the pilot line 44*a* to select the higher one of the pilot pressure in the pilot line 44*a* and the control pressure delivered from the proportional solenoid valve 10*a* and then introduce the selected pressure to the hydraulic driving sector 50*a* of the flow control valve 5*a*. The proportional solenoid valves 10*b*, 11*a*, 11*b* are disposed in the pilot lines 44*b*, 45*a*, 45*b*, respectively, to reduce the pilot pressures in the pilot lines in accordance with the respective electric signals applied thereto and output the reduced pilot pressures.

In the above construction, the excavation area setting system of this embodiment is constituted by the setting device 7, the external reference member 80, the front reference member 70, the external reference setting switch 71, the angle sensors 8*a*, 8*b*, 8*c*, the tilting sensor 8*d*, and the following functions of the control unit 9.

Figure 3:
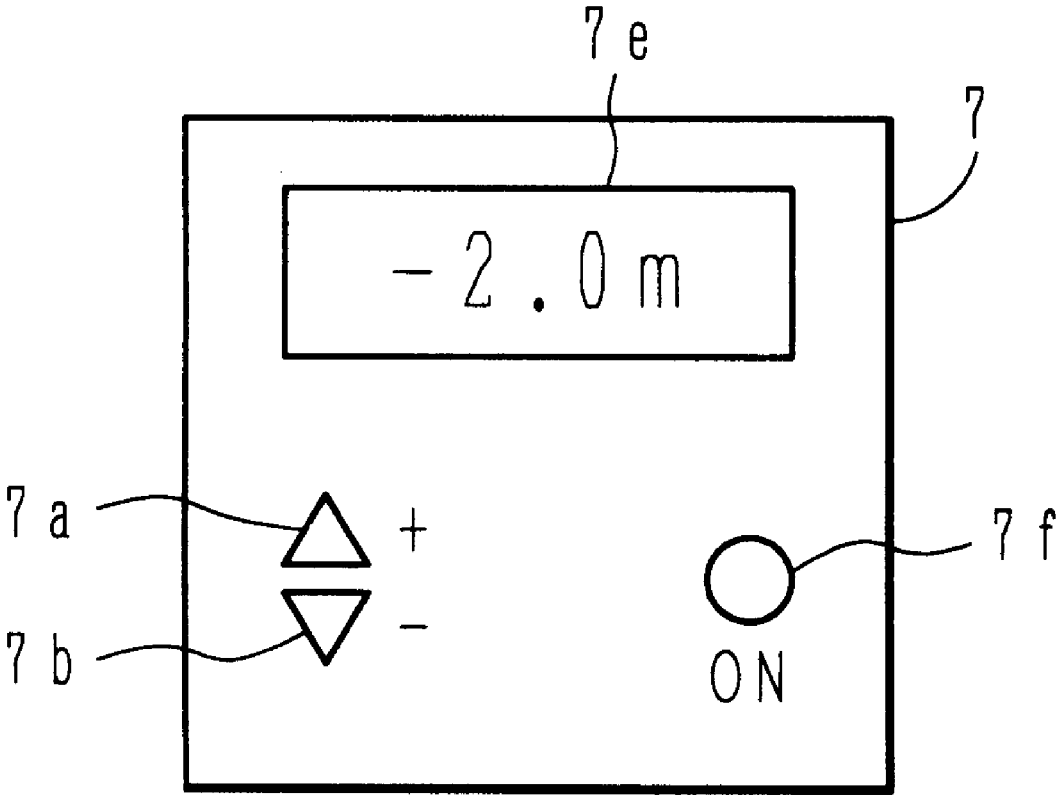
FIG. 3 is a illustrating a setting device.

The setting device 7 comprises, as shown in FIG. 3, up and down buttons 7*a*, 7*b* for entering a depth of the excavation area, a display 7*e* for displaying the entered depth, and an area setting switch 7*f* for outputting the entered depth as a setup signal to the control unit 9 to instruct setting of the excavation area. The buttons and so on of the setting device 7 may be provided on a grip of an appropriate control lever. Also, the setting of the excavation area may be instructed by any of other suitable methods such as using IC cards, bar codes, and wireless communication.

The external reference member 80 is, e.g., a baseline string horizontally stretched between poles 80*a* as shown in FIG. 2. The baseline string is often used in the job site to indicate a reference line. The external reference member 80 may be any other member, e.g., a simple pole, so long as the operator of the hydraulic excavator can confirm the external reference from it.

Figure 4:
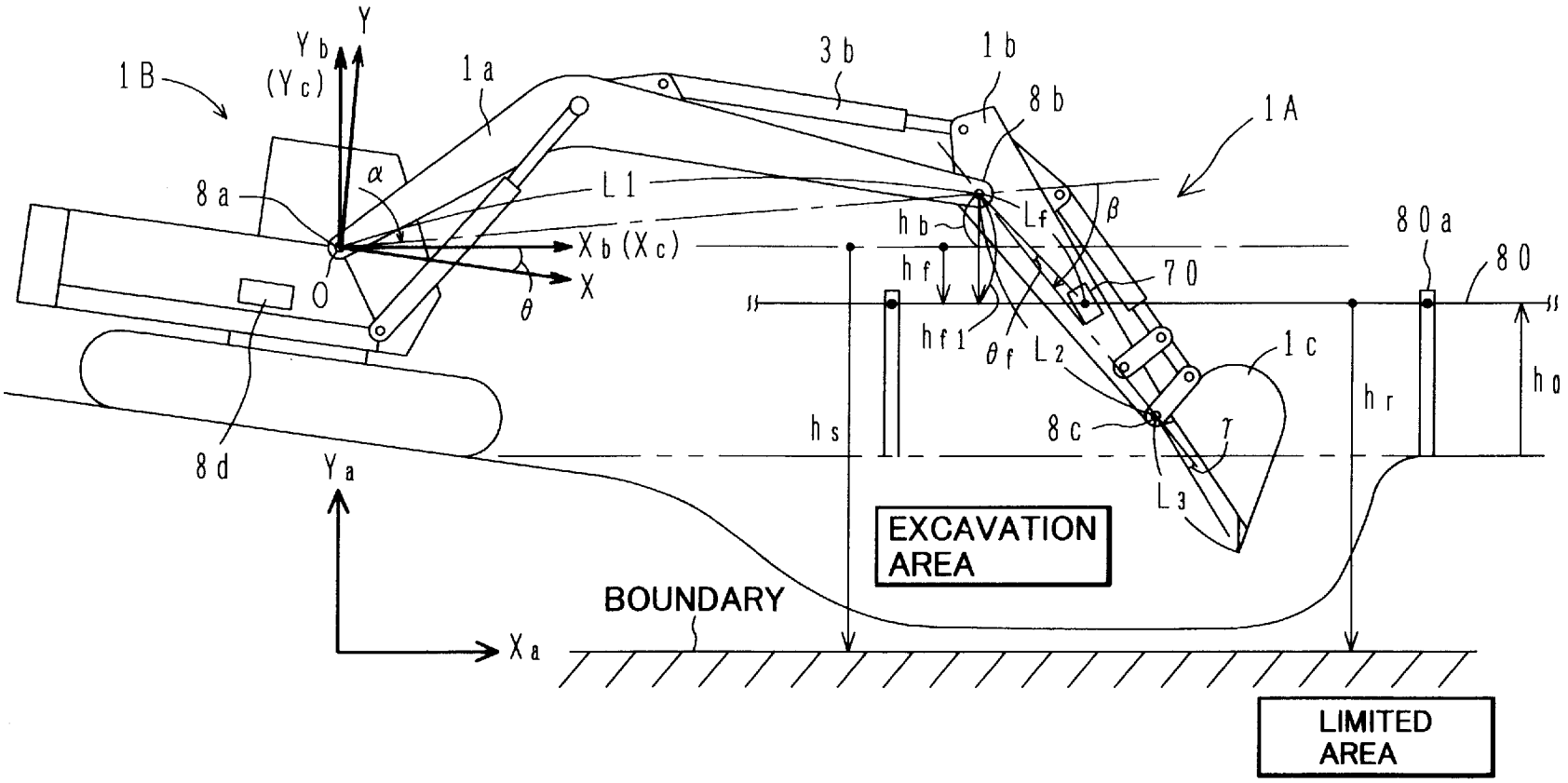
FIG. 4 is a view showing the relationship between an excavation area and an external reference when the excavation area is set by the excavation area setting system of the first embodiment.

The front reference member 70 is a mark provided in a position on the front device 1A which can be confirmed by the operator, as shown in FIG. 4. The mark 70 may be prepared by molding steel into the form of an arrow, for example, and welding the arrow to a prescribed position on the front device.

The external reference setting switch 71 is depressed in the above case when the front device 1A is moved to a position where the arrow as the front reference 70 is aligned with the baseline string as the external reference 80. In response to the depression of the switch 71, the position of the external reference 80 is detected and the positional relationship between the body 1B of the hydraulic excavator and the external reference 80 (i.e., the position of the external reference 80 relative to the body) is set through calculation (as described later).

Alternatively, it is also possible to employ, as the external reference member 80, a laser reference beam oscillator (laser lighthouse) which is conventionally used for a survey or other purposes in the job site, and as the front reference member 70, a laser sensor for detecting a laser beam emitted from the laser lighthouse. In that case, the same function as in the illustrated embodiment can be achieved by turning on a lamp when the beam from the laser lighthouse is detected by the laser sensor, and depressing the external reference setting switch 71 upon the operator confirming turning-on of the lamp.

To minimize the effect of manufacturing tolerances of the body in calculation for setting the excavation area, the front reference member 70 is preferably disposed as close as possible to a tip of the arm 1*b* to such an extent that working is not interfered with, and aligned with the external reference 80 in a position near the bucket 1*c* which actually acts on the earth. The external reference setting switch 71 may be incorporated in the setting device 7.

The control unit 9 sets an excavation area by using the setup signal of the setting device 7 and the detection signals of the external reference setting switch 71, the angle sensors 8*a*, 8*b*, 8*c* and the tilting sensor 8*d*. A manner of setting an excavation area by the control unit 9 and a summary of processing functions of the control unit 9 will now be described with reference to FIGS. 4 and 5. It is to be noted that an excavation area is set by setting a boundary between the excavation area and a forbidden area (hereinafter referred to simply as a boundary of the excavation area), and that the boundary of the excavation area is set as a horizontal plane in this embodiment.

When setting an excavation area, a baseline string, for example, is first stretched as the external reference member 80 outside the hydraulic excavator itself, as shown in FIG. 4.

Then, the operator enters a depth hr from the external reference 80 to the boundary of the excavation area to be set by using the setting device 7, thus setting the positional relationship between the external reference 80 and the excavation area in accordance with the depth hr. In other words, the excavation area is set with the position of the external reference 80 as a reference. This setting is executed by a processing function of first setting means 100 of the control unit 9 shown in FIG. 5.

Next, an excavation area on the basis of the current body position of the hydraulic excavator is set. To this end, the operator first moves the front device 1A so that the front reference 70 provided on the arm 1*b* of the front device 1A is aligned with the external reference 80. Upon the alignment between both the references, the operator depresses the external reference setting switch 71. While the front device 1A is being moved, the current position and posture of the front device 1A are calculated in the control unit 9 by a processing function of first calculating means 120, shown in FIG. 5, from the signals of the angle sensors 8*a*, 8*b*, 8*c* and the tilting sensor 8*d*. When the front reference 70 provided on the arm 1*b* of the front device 1A is aligned with the external reference 80 and the operator depresses the external reference setting switch 71, a height hf from a reference point O on the body to the external reference 80 is calculated as the positional relationship between the body 1B and the external reference 80 by a processing function of second calculating means 140, shown in FIG. 5, based on information about the position and posture of the front device 1A obtained by the first calculating means 120 at that time. With the height hf being a modification value, a depth hs of the boundary of the excavation area relative to the body reference point O is calculated from the previously set hr (i.e., the positional relationship between the external reference 80 and the excavation area). Then, the depth hs is set as the excavation area on the basis of the body 1B of the hydraulic excavator by a processing function of second setting means 160 shown in FIG. 5. Upon completion of setting the excavation area on the basis of the body 1B of the hydraulic excavator, the process flow goes to area limiting excavation control as shown by block 180 in FIG. 5.

Here, the body reference point O is coincident with the pivot point of the boom 1*a* and serves as the origin of an XY-coordinate system, an XbYb-coordinate system and an XcYc-coordinate system (described later) which are used for calculation in the area limiting excavation control.

The setting of the excavation area on the basis of the body 1B of the hydraulic excavator is carried out whenever the external reference setting switch 71 is depressed. Thus, even when the hydraulic excavator is travelled to a different position, the setting of the excavation area is newly carried out in that position.

Figure 6:
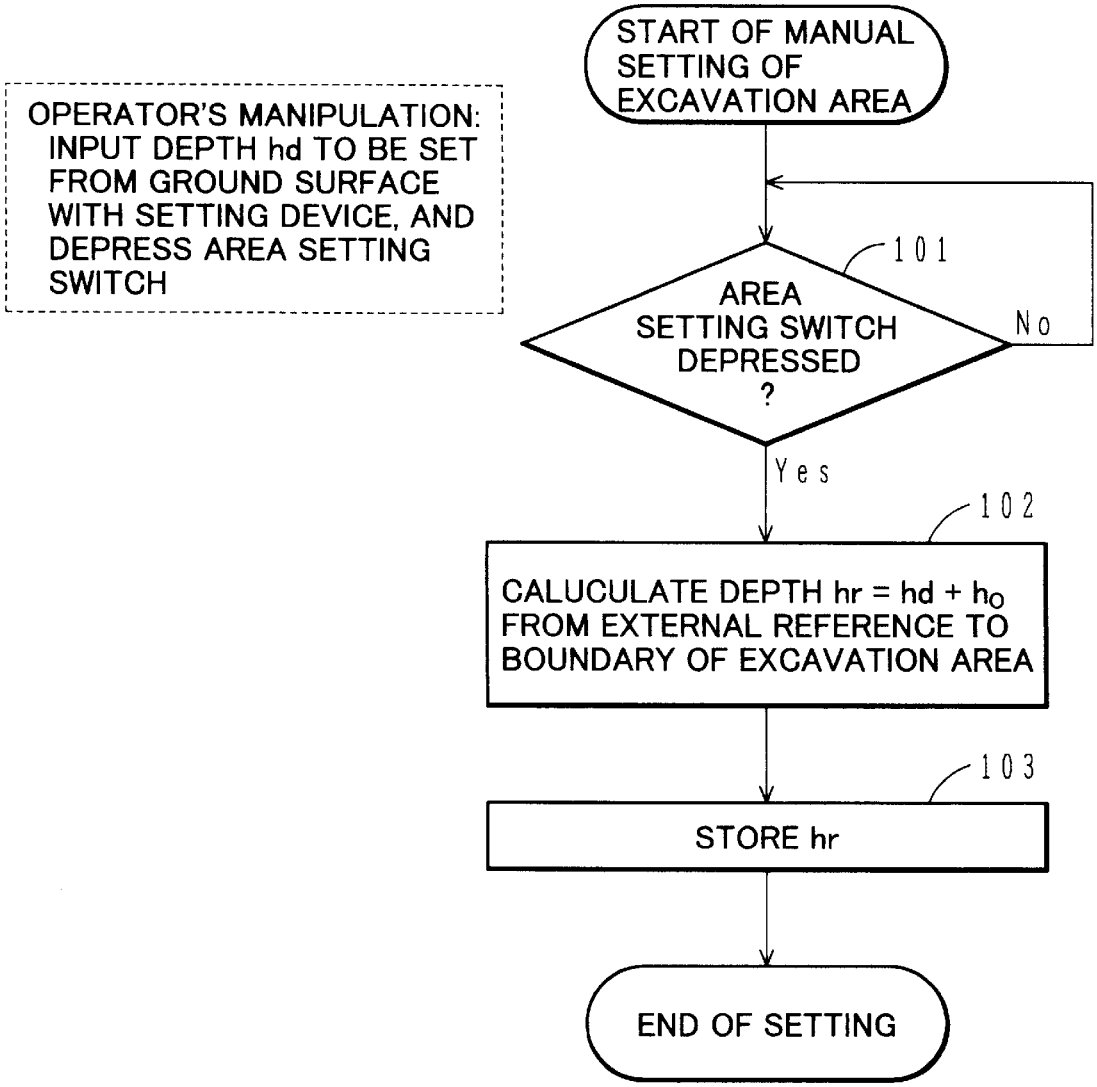
FIG. 6 is a flowchart showing a process flow of a first setting means in the excavation area setting system of the first embodiment.

Details of the function of setting the positional relationship between the external reference 80 and the excavation area in the first setting means 100 is shown in a process flow chart of FIG. 6. In FIG. 6, a block circumscribed by broken lines represents manipulation to be performed by the operator of the hydraulic excavator.

First, the operator determines a depth hd from the ground surface to the boundary of the excavation area to be set, by referring to the design and working drawings, etc. Then, the operator inputs a value of the depth hd by using the buttons 7*a*, 7*b* of the setting device 7 and depresses the area setting switch 7*f* upon confirming on the display 7*e* that the value has been input. The control unit 9 determines in step 101 whether the area setting switch 7*f* is depressed or not. If not depressed, the control unit 9 repeats step 101, but if depressed, it goes to step 102. In step 102, a depth hr from the external reference 80 to the boundary of the excavation area to be set is calculated from the following formula (1):

$$hr=hd+ho \quad (1)$$

In the formula (1), ho represents a height of the external reference 80 (height from the ground surface to the external reference 80). This value ho is known and stored in the control unit 9 beforehand. Then, the control unit 9 goes to step 103 for storing the depth hr. It is also possible that the operator may keep the height ho of the external reference 80 in his mind and directly input the height hr inclusive of the height ho by using the setting device 7. As an alternative, a button for entering the height ho of the external reference 80 may be provided on the setting device 7 so that a set value of the height ho may be changed upon manipulation by the operator.

Figure 7:
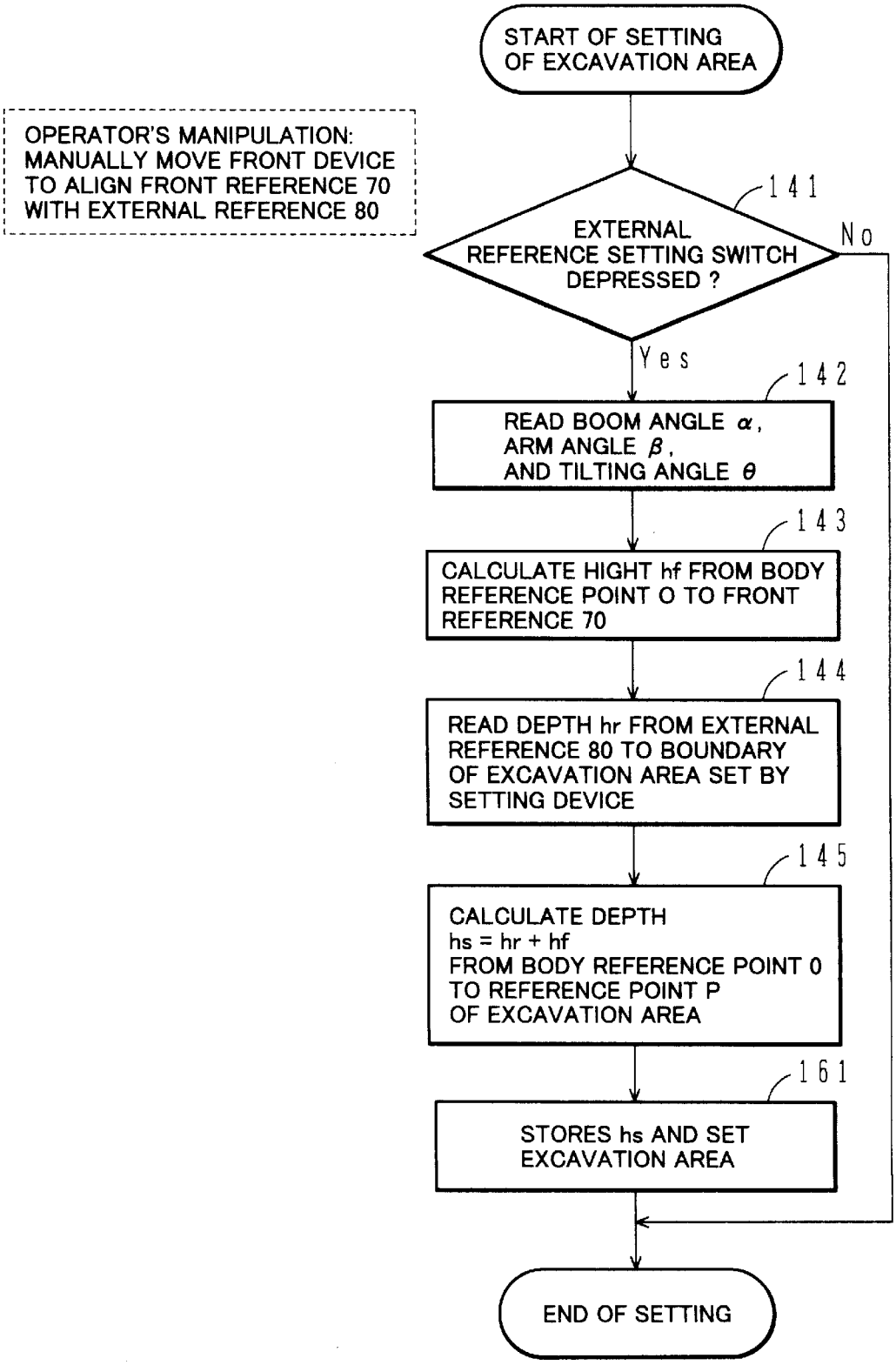
FIG. 7 is a flowchart showing a process flow of a second calculating means and second setting means in the excavation area setting system of the first embodiment.

Details of the function of setting the positional relationship between the body and the excavation area in the second calculating means 140 and the second setting means 160 is shown in a process flow chart of FIG. 7.

First, as indicated in a block circumscribed by broken lines, the operator manipulates the control levers 40 (see FIG. 1) to move the front device 1A so that the front reference 70 is aligned with the external reference 80. Then, the control unit 9 determines in step 141 whether the external reference setting switch 71 is depressed by the operator or not. If not depressed, the control unit 9 brings the setting process to an end without changing the setting of the excavation area. If the external reference setting switch 71 is determined in step 141 as being depressed, the control unit 9 goes to step 142.

In step 142, the control unit 9 reads an angle α of the boom 1*a*, an angle β of the arm 1*b* and a tilting angle θ of the body 1B from the angle sensors 8*a*, 8*b* and the tilting sensor 8*d* which area provided on the front device 1A. Next, in step 143, a height hf from the body reference point α to the front reference 70 which results when the external reference setting switch 71 is depressed (i.e., the front reference 70 is aligned with the external reference 80), is calculated from the angle α of the boom 1*a*, the angle β of the arm 1*b* and the tilting angle θ.

In this calculation process, a height hb from the body reference point O to the joint point between the boom and the arm (i.e., the point where the arm angle sensor 8*b* is mounted) is first determined from the following formula (2):

$$hb=L1\times\cos(\alpha-\theta) \quad (2)$$

In the formula (2), L1 represents a distance from the joint point between the boom 1*a* and the body 1B (i.e., the point where the boom angle sensor 8*a* is mounted) to the joint point between the boom and the arm. A value of the distance L1 is known and stored in the control unit 9 beforehand.

Then, a height hf1 from the joint point between the boom and the arm to the front reference 70 is determined from the following formula (3):

$$hf1=Lf\times\cos((\alpha-\theta)+(\beta-\theta f)) \quad (3)$$

In the formula (3), Lf represents a distance from the joint point between the boom and the arm to the front reference 70, and θf represents a mounting angle of the front reference member 70 relative to a straight line connecting the joint point between the boom and the arm and the joint point between the arm and the bucket (i.e., the point where the bucket angle sensor 8*c* is mounted). Values of these parameters are is known and stored in the control unit 9 beforehand.

Subsequently, a height hf from the body reference point O to the front reference 70 is calculated from the following formula (4) based on the heights hb and hf1:

$$hf=hb+hf1 \quad (4)$$

Next, the control unit 9 goes to step 144 for reading the depth hr from the external reference 80 to the boundary of the excavation area which has been set by using the setting device 7.

Then, in step 145, by using as a modification value the above-calculated height hf from the body reference point O to the front reference 70, a depth hs from the body reference point O to the boundary of the excavation area is calculated from the following formula (5) based on the value hf and the depth hr from the external reference 80 to the boundary of the excavation area:

$$hs=hr+hf \quad (5)$$

Finally, in step 161, the control unit 9 stores the depth hs from the body reference point O to the boundary of the excavation area which has been calculated in step 145, and sets the excavation area on the basis of the body.

Figure 5:
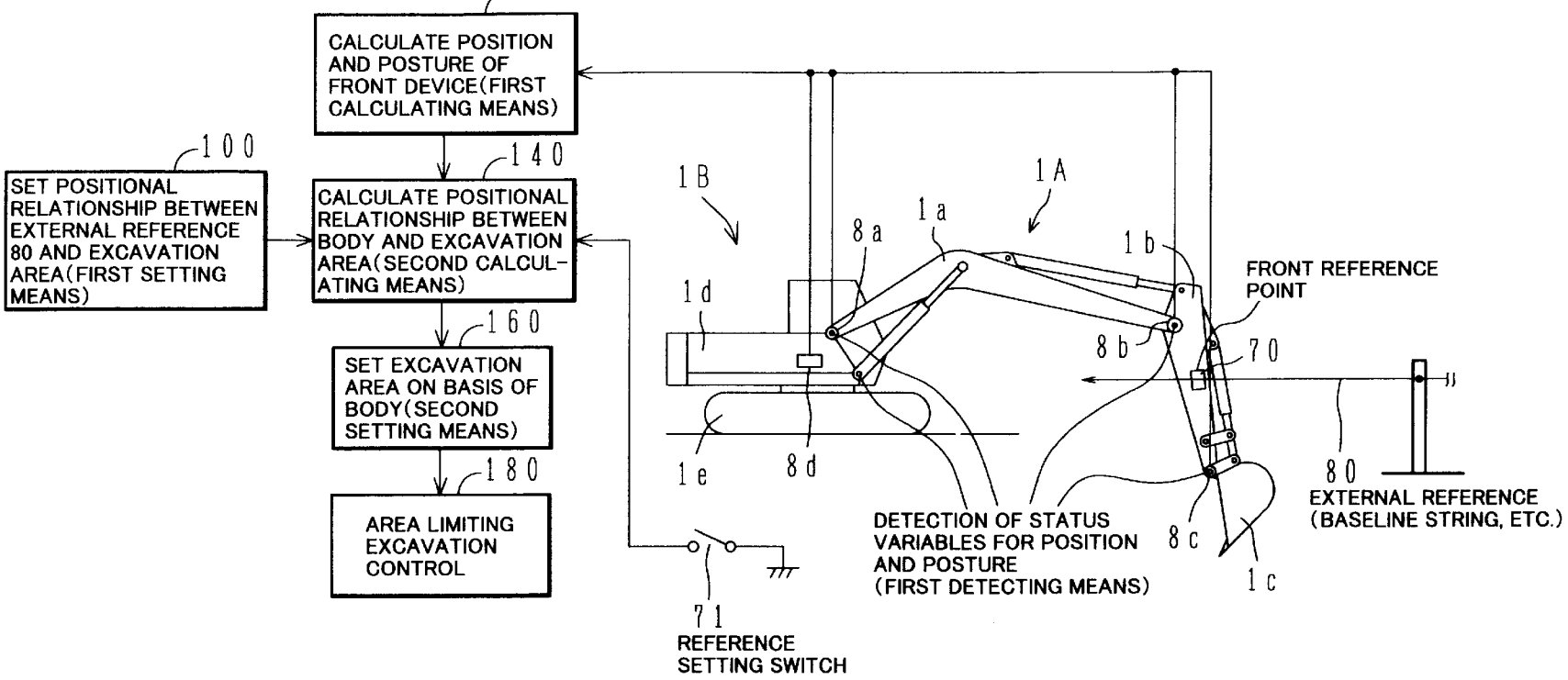
FIG. 5 is a diagram showing an entire configuration of the excavation area setting system of the first embodiment.

In the foregoing process flow, the steps 141 to 145 correspond to the processing function of the second calculating means shown in FIG. 5, and the step 161 corresponds to the processing function of the second setting means 160 shown in FIG. 5.

Upon the start of excavation work after completion of the above steps, the process flow goes to calculation for the area limiting excavation control.

Figure 8:
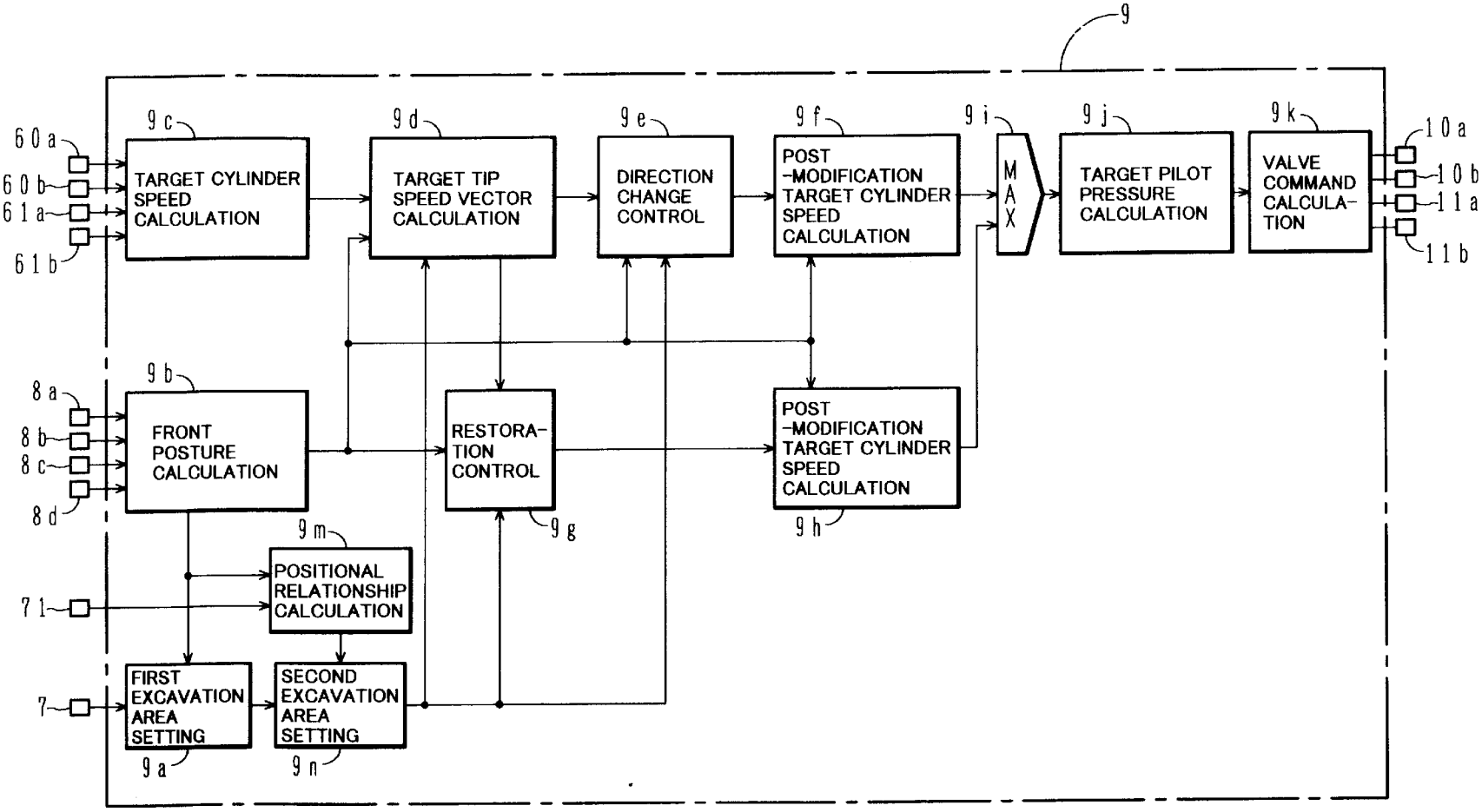
FIG. 8 is a functional block diagram showing the entire control functions of a control unit.

Entire control functions of the control unit 9 including the above-described excavation area setting function will now be described with reference to FIG. 8. In FIG. 8, the control unit 9 includes functions executed by a first excavation area setting portion 9*a*, a front posture calculating portion 9*b*, a target cylinder speed calculating portion 9*c*, a target tip speed vector calculating portion 9*d*, a direction change control portion 9*e*, a post-modification target cylinder speed calculating portion 9*f*, a restoration control calculating portion 9*g*, a post-modification target cylinder speed calculating portion 9*h*, a target cylinder speed selector 9*i*, a target pilot pressure calculating portion 9*j*, a valve command calculating portion 9*k*, a positional relationship calculating portion 9*m*, and a second excavation area setting portion 9*n*.

The first excavation area setting portion 9*a* corresponds to the first setting means 100 in FIG. 5 and sets the positional relationship between the external reference 80 and the excavation area based on the depth hr from the external reference 80 to the boundary of the excavation area through the steps 101 to 103 of the process flow shown in FIG. 6.

The front posture calculating portion 9*b* corresponds to the first calculating means 120 in FIG. 5 and calculates the position and posture of the front device 1A necessary for setting and control based on various dimensions of the front device 1A and the body 1B which are stored in the control unit 9, rotational angles α, β, γ detected respectively by the angle sensors 8*a*, 8*b*, 8*c*, and a tilting angle θ detected by the tilting sensor. The positional relationship calculating portion 9*m* corresponds to the second calculating means 140 in FIG. 5 and calculates the depth hs from the body reference point O to the boundary of the excavation area through the steps 141 to 145 of the process flow shown in FIG. 7.

The second excavation area setting portion 9*n* corresponds to the second setting means 160 in FIG. 5 and sets the excavation area on the basis of the body 1B of the hydraulic excavator from the aforementioned depth hs through the step 161 of the process flow shown in FIG. 7.

In the front posture calculating portion 9*b*, the position and posture of the front device 1A are calculated on an XY-coordinate system with the origin defined by the pivot point of the boom 1*a* which is also the body reference point O serving as a reference for setting the excavation area. The XY-coordinate system is a rectangular coordinate system fixed on the body 1B and is assumed to lie in a vertical plane. Given that the distance between the pivot point of the boom 1*a* and the pivot point of the arm 1*b* is L1, the distance between the pivot point of the arm 1*b* and the pivot point of the bucket 1*c* is L2, and the distance between the pivot point of the bucket 1*c* and the tip of the bucket 1*c* is L3, coordinate values on the XY-coordinate system are determined from formulae below:

$$X=L1\ \sin\alpha+L2\ \sin(\alpha+\beta)+L3\ \sin(\alpha+\beta+\gamma)$$

$$Y=L1\ \cos\alpha+L2\ \cos(\alpha+\beta)+L3\ \cos(\alpha+\beta+\gamma)$$

When the body 1B is inclined as shown in FIG. 4, the relative positional relationship between the bucket tip and the ground surface is changed and thus the setting of the excavation area cannot be performed correctly. In this embodiment, therefore, the tilting angle θ of the body 1B is detected by the tilting sensor 8*d* and a detected value of the tilting angle θ is input to the front posture calculating portion 9*b* so that it can make calculation on an XbYb-coordinate system which is provided by rotating the XY-coordinate system through the angle θ. This enables the area setting and the excavation control to be correctly performed even if the body 1B is inclined. Note that the tilting sensor is not always required when work is started after correcting a tilting of the body if the body is inclined, or when excavation is performed in the work site where the body will not incline.

In the first excavation area setting portion 9*a*, the modification value calculating portion 9*m* and the second excavation area setting portion 9*n*, the depths hr, hs, the height hf, etc. are processed after being transformed into respective values on the XbYb-coordinate system.

The target cylinder speed calculating portion 9*c* receives the detection signals of the pressure sensors 60*a*, 60*b*, 61*a*, 61*b* as operation signals input from the control lever units 4*a*, 4*b*. From the operations signals (pilot pressures), the calculating portion 9*c* calculates target supply flow rates through the flow control valves 5*a*, 5*b* (target speeds of the boom cylinder 3*a* and the arm cylinder 3*b*).

The target tip speed vector calculating portion 9*d* determines a target speed vector Vc at the tip of the bucket 1*c* from the position of the bucket tip determined by the front posture calculating portion 9*b*, the target cylinder speed determined by the target cylinder speed calculating portion 9*c*, and the various dimensions, such as L1, L2 and L3, stored in the control unit 9. At this time, the target speed vector Vc is first calculated as values on the XY-coordinate system shown in FIG. 4, and then transformed into values on the XbYb-coordinate system shown in FIG. 4 when the body is inclined. Further, taking into account the case where the boundary of the excavation area is inclined an angle θr (see later-described embodiments shown in FIGS. 12 and 16), the target speed vector Vc is finally determined as values on an XcYc-coordinate system which is provided by rotating the XbYb-coordinate system through the angle θr. Thus, the target speed vector Vc is calculated on the basis of the body reference point O. Here, an Xc-coordinate component Vcx of the target speed vector Vc on the XcYc-coordinate system represents a vector component in the direction parallel to the boundary of the set area, and a Yc-coordinate component Vcy thereof represents a vector component in the direction vertical to the boundary of the set area.

When the tip of the bucket 1*c* is positioned within the set area near the boundary thereof and the target speed vector Vc has a component in the direction toward the boundary of the set area, the direction change controller 9*e* modifies the vertical vector component such that it is gradually reduced as the bucket tip comes closer to the boundary of the set area. In other words, a vector (reversed vector) being smaller than the vector component Vcy in the vertical direction and orienting away from the set area is added to the vector component Vcy.

Here, in the direction change controller 9*e*, it is required to know a distance between the tip of the bucket 1*c* and the boundary of the set area. To this end, a rectangular XaYa-coordinate system having the origin on the boundary of the set area and one axis defined by a straight line aligning with the boundary is set and the position of the bucket tip on the XaYa-coordinate system is calculated. The XaYa-coordinate system is a coordinate system obtained by translating the XcYc-coordinate system through the depth hs of the boundary of the excavation area from the body reference point O determined by the second excavation area setting portion 9*n* and, therefore, the position of the bucket tip on the XaYa-coordinate system can be readily determined. Then, a Ya-coordinate value (hereinafter referred to simply as Ya) on the XaYa-coordinate system represents the distance between the tip of the bucket 1*c* and the boundary of the set area.

By the modification in the direction change control portion 9*e*, the vector component Vcy in the vertical direction is reduced such that the amount of reduction in the vector component Vcy is increased as the distance Ya decreases. Thus, the target speed vector Vc is modified into a target speed vector Vca. Here, the range of a distance Ya1 from the boundary of the set area can be called a direction change area or a slowdown area.

Figure 9:
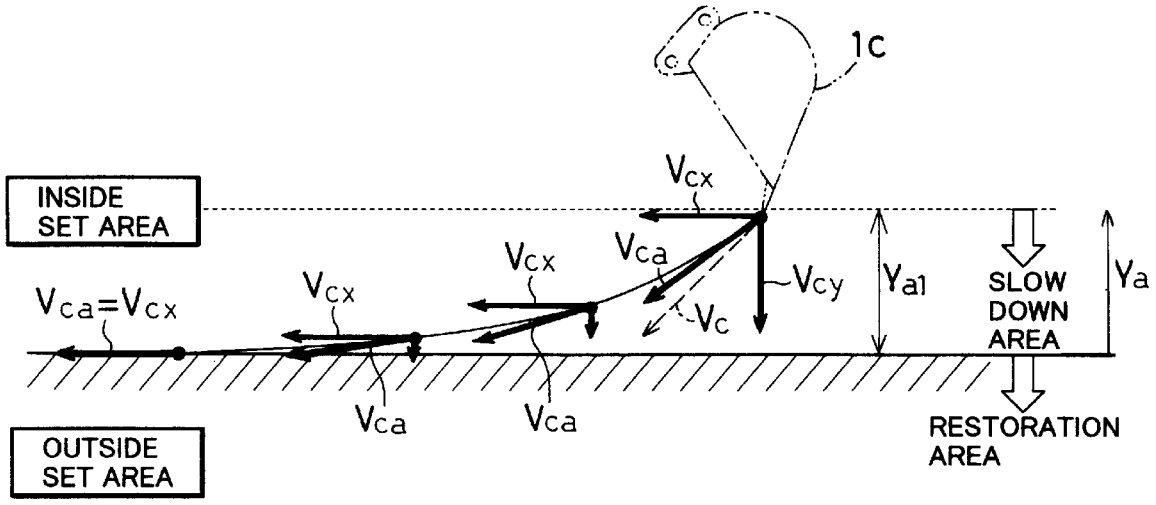
FIG. 9 is a diagram showing one example of a path along which a bucket tip is moved when direction change control is performed as per calculation during area limiting excavation control.

FIG. 9 shows one example of a path along which the tip of the bucket 1*c* is moved when the direction change control is performed as per the above-described target speed vector Vca after modification. Given that the target speed vector Vc is oriented downward obliquely and constant, its parallel component Vcx remains the same and its vertical component Vcy is gradually reduced as the tip of the bucket 1*c* comes closer to the boundary of the set area (i.e., as the distance Ya decreases). Because the target speed vector Vca after modification is a resultant of both the parallel and vertical components, the path is in the form of a curved line which is curved to become parallel by degrees while approaching the boundary of the set area, as shown in FIG. 9.

The post-modification target cylinder speed calculating portion 9*f* calculates target cylinder speeds of the boom cylinder 3*a* and the arm cylinder 3*b* from the target speed vector after modification determined by the direction change control portion 9*e*. This process is a reversal of the calculation executed by the target tip speed vector calculating portion 9*d*.

When the direction change control is performed, the directions in which the boom cylinder and the arm cylinder are required to be operated to achieve the direction change control are selected and the target cylinder speeds in the selected operating directions are calculated. A description will now be made of, by way of example, the case of crowding the arm with the intention of digging the ground toward the body (i.e., the arm crowding operation) and the case of operating the bucket tip in the direction to push it by the combined operation of boom-down and arm dumping (i.e., the arm-dumping combined operation).

In the arm crowding operation, the vertical component Vcy of the target speed vector Vc can be reduced in three ways below:

(1) raising the boom 1*a;*

(2) slowing down the operation to crowd the arm 1*b*; and (3) combining the methods (1) and (2).

In the combined method (3), proportions of the two methods are dependent on the posture of the front device, the horizontal vector component, etc. at that time. Anyway, the proportions are determined in accordance with the control software. Since this embodiment includes restoration control as well, the method (1) or (3) including raise-up of the boom 1*a* is preferable. Taking into account smoothness of the operation, the method (3) is most preferable.

In the arm-dumping combined operation, when the arm is moved for dumping from a position near the body (nearby position), the target vector in the direction of going out of the set area is provided. To reduce the vertical component Vcy of the target speed vector Vc, therefore, it is required to slow down the arm dumping operation by slowing down the boom-down operation or switching it to the boom-up operation. The combination of arm-dumping and any other operation mode is also determined in accordance with the control software.

In the restoration control portion 9*g*, when the tip of the bucket 1*c* goes out of the set area, the target speed vector is modified depending on the distance from the boundary of the set area so that the bucket tip is returned to the set area. In other words, a vector (reversed vector) being larger than the vector component Vcy in the vertical direction and orienting toward the set area is added to the vector component Vcy. As with the above direction change control, the position of the bucket tip on the XaYa-coordinate system is calculated and a Ya-coordinate value on the XaYa-coordinate system is taken as the distance between the tip of the bucket 1*c* and the boundary of the set area. By thus modifying the vertical vector component Vcy of the target speed vector Vc, the target speed vector Vc is modified into a target speed vector Vca such that the vertical vector component Vcy is reduced as the distance Ya decreases.

Figure 10:
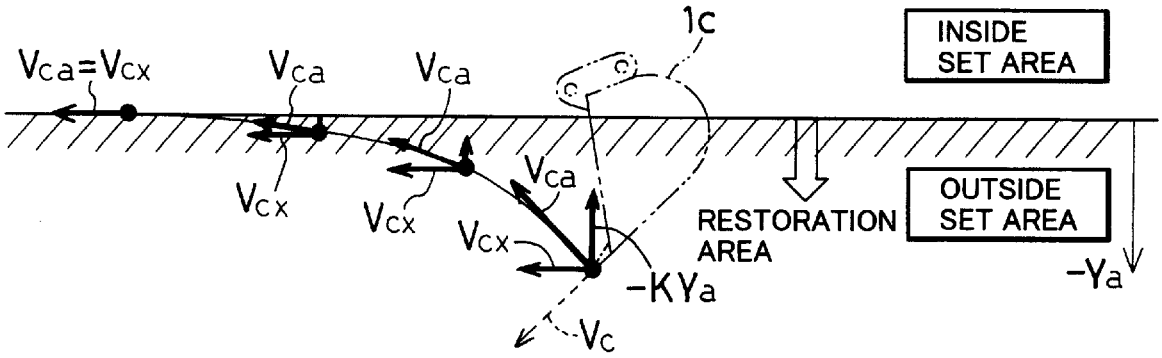
FIG. 10 is a diagram showing one example of a path along which the bucket tip is moved when restoration control is performed as per calculation during the area limiting excavation control.

FIG. 10 shows one example of a path along which the tip of the bucket 1*c* is moved when the restoration control is performed as per the above-described target speed vector Vca after modification. Given that the target speed vector Vc is oriented downward obliquely and constant, its parallel component Vcx remains the same and a restoration vector—KYa is proportional to the distance Ya such that a vertical component is gradually reduced as the tip of the bucket 1*c* comes closer to the boundary of the set area (i.e., as the distance Ya decreases). Because the target speed vector Vca after modification is a resultant of both the parallel and vertical components, the path is in the form of a curved line which is curved to become parallel by degrees while approaching the boundary of the set area, as shown in FIG. 10.

Thus, since the tip of the bucket 1*c* is controlled to return to the set area by the restoration control portion 9*g*, a restoration area is defined outside the set area. In the restoration control, the movement of the tip of the bucket 1*c* toward the boundary of the set area is also slowed down and, eventually, the direction in which the tip of the bucket 1*c* is moving is converted into the direction along the boundary of the set area. In this meaning, the restoration control can also be called direction change control.

The post-modification target cylinder speed calculating portion 9*h* calculates target cylinder speeds of the boom cylinder 3*a* and the arm cylinder 3*b* from the target speed vector after modification determined by the restoration control portion 9*g*. This process is a reversal of the calculation executed by the target tip speed vector calculating portion 9*d*.

When the restoration control is performed, the directions in which the boom cylinder and the arm cylinder are required to be operated to achieve the restoration control are selected and the target cylinder speeds in the selected operating directions are calculated. Since the bucket tip is returned to the set area by raising the boom 1*a* in the restoration control, the direction of raising the boom 1*a* is always included. The combination of boom-up and any other mode is also determined in accordance with the control software.

The target cylinder speed selector 9*i* selects the larger one (maximum value) of a value of the target cylinder speed determined by the target cylinder speed calculating portion 9*f* for the direction change control and a value of the target cylinder speed determined by the target cylinder speed calculating portion 9*h* for the restoration control, and then sets the selected value as a target cylinder speed to be output.

The target pilot pressure calculating portion 9*j* calculates, as the target pilot pressures, target pilot pressures to be produced in the pilot lines 44*a*, 44*b*; 45*a*, 45*b*.

The valve command calculating portion 9*k* calculates command values corresponding to the target pilot pressures calculated by the target pilot pressure calculating portion 9*j*, and outputs electric signals corresponding to the command values to the proportional solenoid valves 10*a*, 10*b*, 11*a*, 11*b*.

In this embodiment described above, each time the front reference 70 is aligned with the external reference 80 and, in such a condition, the external reference setting switch 71 is depressed in accordance with the intention of the operator, the positional relationship between the external reference 80 and the body 1B is modified and the positional relationship between the body and the excavation area is calculated, enabling the excavation area to be set on the basis of the body. Therefore, the operator can perform excavation work while compensating change in the body height caused by movement of the body in accordance with his intention whenever it occurs. As a result, even when the body height is changed upon movement of the body, the setting of the excavation area remains the same, enabling excavation work to be always carried out at a predetermined depth on the basis of the external reference 80.

Further, the front reference 70 is disposed on the arm 1*b* in a position nearer to the bucket tip of the front device 1A including the bucket which actually acts on the ground, and the excavation area on the basis of the body 1B is set from the position and posture of the front device 1A resulted when the front reference 70 is aligned with the external reference 80 and the external reference setting switch 71 is depressed. Therefore, the effect of errors, such as manufacturing tolerances of the body 1B or tolerances in accuracy and mounting of the front reference member 70 and the angle sensors 8*a*–8*c*, upon the setting of the excavation area is offset through the calculation for setting the excavation area and the calculation for the excavation control. Accordingly, when the tip position of the bucket 1*c* is calculated in the excavation control, a calculation result is less affected by the above-mentioned tolerances and other errors in accuracy than the conventional method of detecting reference light by a sensor mounted on the body, and excavation can be precisely performed as per the setting with a smaller difference from the set excavation area.

This point will now be described below in more detail. In the related art disclosed in the above-cited JP-A-3-295933, the vehicle height can be compensated with the aid of reference light as stated before. When excavation is performed in the related art, the body height is modified and control is made so that a bucket tip is moved to a depth hs set with respect to a body reference point O. At this time, a control device executes calculation and control to position the bucket tip at the depth hs based on dimensions L1, L2, L3 of a boom, an arm and a bucket stored in a memory and angles α, β, γ of front members detected by angle sensors. However, the actual front members include manufacturing errors, and the boom, the arm and the bucket actually have dimensions of, e.g., L1+εL1, L2+εL2 and L3+εL3, respectively. Also, the angles α, β, γ detected by the angle sensors include respective errors εα, εβ, εγ, due to mounting errors of the sensors, detection errors of the sensors themselves, etc., relative to true angles α', β', γ'. Therefore, even when the control device attempts to make control to move the bucket tip to hs (L1, L2, L3, α(hs), β(hs), γ(hs)), a position to which the bucket tip is actually moved is given by:

$$hs'(L1', L2', L3', \alpha'(hs), \beta'(hs, \gamma'(hs))=hs'(L1+\epsilon L1, L2+\epsilon L2, L3+\epsilon L3, \alpha(hs)+\epsilon\alpha, \beta(hs)+\epsilon\beta, \gamma(hs)+\epsilon\gamma) \quad (6)$$

where L1, L2, L3: design values

α, β, γ: detected values

L1', L2', L3', α', β', γ': actual values

εL1, εL2, εL3, εα, εβ, εγ: errors

L1'=L1+εL1

L2'=L2+εL2

L3'=L3+εL3

α=α'+εα

β=β'+εβ

γ=γ'+εγ and where α(hs), β(hs), γ(hs) and α'(hs), β'(hs), γ'(hs) represent detected values and actual values of the respective angles taken when the front device is in a posture of detecting the depth hs.

Assuming a target boom angle to be 30°, for example, the control device controls the front device so that the detected value α(hs) is 30° (α(hs)=30°). At this time, if there is an error εα=0.5° between the detected value α and the actual α', the front device would be actually controlled to the position of α'=30.5°.

On the other hand, in this embodiment, since the front reference 70 is provided on the front device (arm), the position taken by the front reference 70 when it is aligned with the external reference 80, is recognized by the control unit 9 as a position calculated below:

hf (L1, Lf, α(hf), β(hf), θf)

At this time, the front reference 70 actually locates in a position below:

$$hf'(L1', Lf', \alpha'(hf), \beta'(hf), \theta f')=hf'(L1+\epsilon L1, Lf+\epsilon Lf, \alpha(hf)+\epsilon\alpha, \beta(hf)+\epsilon\beta, \theta f+\epsilon\theta f)$$

A position of the bucket tip at this time is given by:

$$(L1', L2', L3', \alpha'(hf), \beta'(hf), \gamma'(hf))=(L1+\epsilon L1, L2+\epsilon Lf, L3+\epsilon L3, \alpha(hf)+\epsilon\alpha(hf), \beta(hf)+\epsilon\beta(hf), \gamma(hf)+\epsilon\gamma(hf)) \quad (7)$$

where εθf: mounting error of the front reference 70

α'(hf), β'(hf), γ'(hf): detected values of the angles when the front device is in the posture of detecting hf α'(hf), β'(hf), γ'(hf): actual values of the angles when the front device is in the posture of detecting hf At this time, since the front reference 70 is in the position of the true external reference 80, this means that the control unit 9 has detected the position of the true external reference 80 including errors. If that position hf is employed in the area limitation control, an error between the detected position hf' in the control unit 9 and the actual position hf' is the same as that included at the time of detecting hf. Therefore, when the front reference 70 is moved to the detected position hf, both the errors offset each other and the actual position hf' of the front reference 70 is aligned with the true position.

For example, assuming that the actual boom angle is α'=30° and the detected value of the sensor 8*a* includes an error εα=0.5° when the external reference 80 is detected, the boom angle is detected by the control unit as being α=29.5°. When the boom is controlled so as to take a target angle using the detected value α=29.5°, it is actually controlled to the position of α'=30°, i.e., it is aligned with the true position of the external reference 80. Thus, the error is cancelled out.

Next, when the bucket tip position is controlled by using hs modified based on hf during the area limitation control, the error included in at least hf is cancelled out looking from the actual position of the external reference, as mentioned above, and the remaining error is an error due to the sensors caused when the bucket tip is moved from the posture of detecting hf to a posture of detecting hs. In the posture of detecting hs, the bucket tip is actually in a position below:

$$hs'(L1', L2', L3', \alpha'(hs), \beta'(hs), \gamma'(hs))=hs'(L1+\epsilon L1, L2+\epsilon L2, L3+\epsilon L3, \alpha(hs)+\epsilon\alpha(hs), \beta(hs)+\epsilon\beta(hs), \gamma(hs)+\epsilon\gamma(hs)) \quad (8)$$

where α'(hs), β'(hs), γ'(hs): detected values of the angles when the front device is controlled to the posture of detecting hs α'(hs), β'(hs), γ'(hs): actual values of the angles when the front device is controlled to the posture of detecting hs At this time, in this embodiment, since the bucket tip position in the posture of detecting hf is aligned with the true position of the external reference 80 in accordance with the formula (7), errors relating to deviations α(hs)−α(hf), β(hs)−β(hf), γ(hs)−γ(hf) occurred when the bucket tip is controlled to move from the posture of detecting hf to the posture of detecting hs, i.e.,;

$$\Delta\epsilon\alpha=\epsilon\alpha(hs)-\epsilon\alpha(hf) \quad (9)$$

$$\Delta\epsilon\beta=\epsilon\beta(hs)-\epsilon\beta(hf) \quad (10)$$

$$\Delta\epsilon\gamma=\epsilon\gamma(hs)-\epsilon\gamma(hf) \quad (11)$$

are produced as actual errors when the area limitation excavation is performed, and hence are much smaller than in the prior art. Further, according to this embodiment, by providing the front reference 70 on the front device 1A to make change between the posture of setting the external reference position and the posture during excavation as small as possible, the errors produced in relation to the above formulae (9) to (11) can be further reduced in such a case.

Incidentally, when employing a direct teaching method described later, since an error in setting hr is also taken in at the time of the setting and the bucket tip is controlled to move to hr while cancelling out the error, more precise excavation control can be achieved.

Moreover, the setting in this embodiment is less affected by the errors of the angle sensors 8*a*–8*c* for detecting the position and posture of the front device 1A. Therefore, even when the body height is varied with movement of the body and the excavation depth from the body is changed, the effect of the errors of the angle sensors 8*a*–8*c* upon the change amount of the excavation depth is so small as to prevent change in the excavation depth between before and after the body height is varied.

Additionally, in the related art disclosed in the above-cited JP-A-3-295933, the reference light sensor provided on the body is required to be able to cover a wide range for positive detection of the reference light. By contrast, in this embodiment, since the front device 1A is operated to make the front reference 70 aligned with the external reference 80 and, in this condition, the external reference setting switch 71 is depressed to effect the setting, the front reference member 70 provided on the front device 1A can be formed of a small and simple member, such as an arrow mark of a steel plate, and the movement of the body can be compensated without needing a large-sized and complicated sensor.

Similarly, since the front device 1A is operated to make the front reference 70 aligned with the external reference 80 and, in this condition, the external reference setting switch 71 is depressed to effect the setting, the movement of the body can be compensated over a wide range because of the front device 1A being movable over a wide range.

In the area limiting excavation control stated above, since the target speed vector Vc at the tip of the bucket 1*c* is calculated on the basis of the body reference point O and the movement of the front device 1A is controlled by modifying the target speed vector Vc, it is required to calculate various variables relating to the target speed vector Vc on the basis of the body during the excavation control. In the setting system of this embodiment, the second calculating means 140 and the second setting means 160 are provided in addition to the first setting means 100, the second setting means 160 calculates the positional relationship between the body 1B and the excavation area (i.e., the depth hs) by modifying the positional relationship between the external reference 80 and the excavation area (i.e., the depth hr) which has been set by the first setting means 100, and the second setting means 160 sets the excavation area on the basis of the body as with the excavation control. Therefore, the setting data hs of the excavation area determined by the second setting means 160 can be employed as it is for calculation in the excavation control and thus the calculation in the excavation control can be simplified. As a result, necessary calculation can be executed in a moment with a restricted memory capacity of the control unit 9 and highly reliable area limiting excavation control can be achieved without causing a delay.

Furthermore, this embodiment includes the external reference setting switch 71 to be depressed when the front reference 70 is aligned with the external reference 80, and the operator moves the front device 1A and depresses the external reference setting switch at the time of the front reference being aligned with the external reference. This means that the calculation for setting the excavation area is executed by the second calculating means 140 in advance. Therefore, the calculation for setting the excavation area is not required during the excavation control and the amount of calculation to be executed during the excavation control is reduced, resulting in more highly reliable area limiting excavation control with more positive prevention of a delay.

Figure 11:
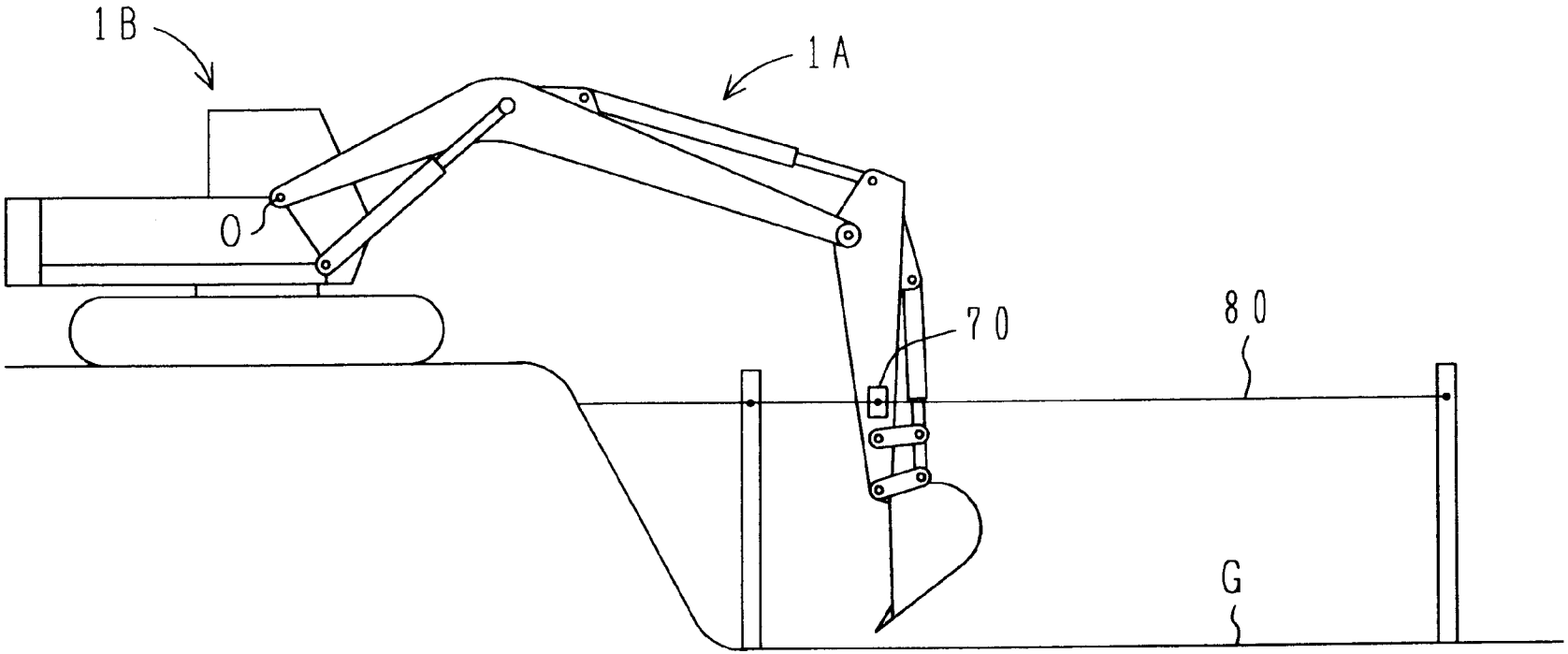
FIG. 11 is a view showing an external reference member installed in a trench when there is no appropriate place capable of installing the external reference member at the same level as a body of the excavator.

In the related art disclosed in the above-cited JP-A-3-295933, the reference light sensor provided on the body is required to be able to cover a wide range for positive detection of the reference light, as stated above, and this requirement poses a great restriction in a level of the reference light, taking into account the size of the reference light sensor. By contrast, in this embodiment, since the front reference member 70 is provided on the front device 1A, particularly the arm, a place where the external reference member 80 is installed is not subjected to substantial restrictions because of the front device being movable over a wide range. This leads to such a merit that as shown in FIG. 11, by way of example, when there is no appropriate place on the ground capable of installing the external reference member at the same level as the body 1B, the external reference member 80 can be installed in a trench G. In this connection, it is also possible to install the external reference member 80 in view of the above-mentioned problem of errors so that change between the posture of positioning the front reference to be aligned with the external reference and the posture during excavation is reduced, and hence to improve the accuracy of excavation.

Further, with this embodiment, by installing the external reference member 80 (baseline string, pole, laser lighthouse or the like) and setting the external reference with the setting device 7 prior to starting work, no assistant operator is necessary to position the tip of the bucket Ic to the boundary of the set area at the start of work or when the hydraulic excavator body is travelled to a different place. In addition, a time required for making the setting in accordance with an instruction from the assistant operator can be eliminated and a working time can be cut down.

The external reference member 80 is installed outside the body, requires not to be changed in its position after once installed, and can be employed as a reference for the excavation area continuously even when the body is moved to a different place.

It is to be noted that while the embodiment has been described as installing the external reference member horizontally, the external reference member is not always required to be installed horizontally. Depending on the nature of scheduled work, the external reference member may be installed obliquely and excavation may be performed step by step while defining a rough slope.

A second embodiment of the present invention will be described with reference to FIGS. 12 to 15. This second embodiment intends to set a sloped excavation area, as the excavation area, in a excavation area setting system for an area limiting excavation control.

Figure 12:
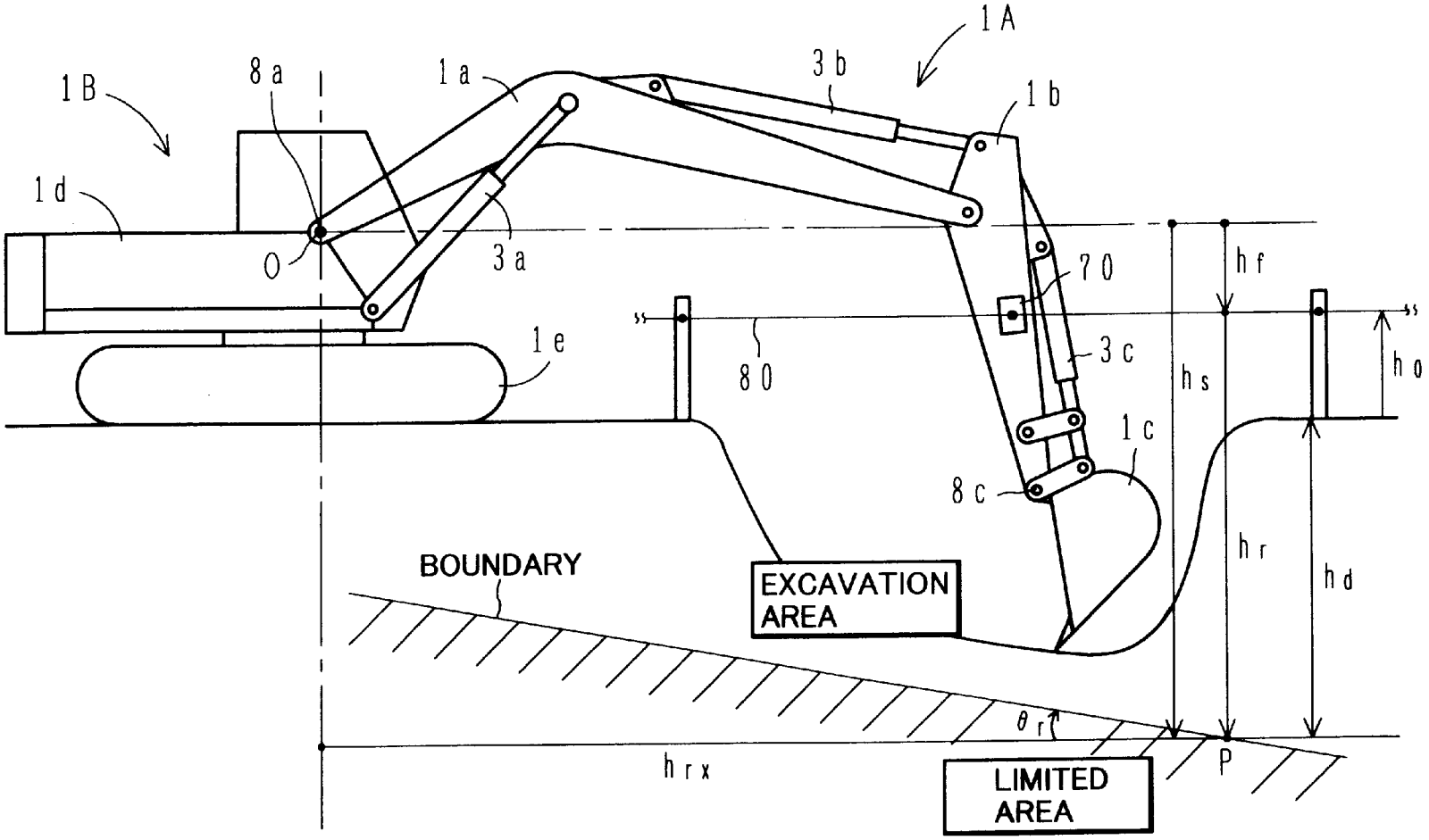
FIG. 12 is a view showing the relationship between an excavation area and an external reference when the excavation area is set by an excavation area setting system of a second embodiment.
Figure 13:
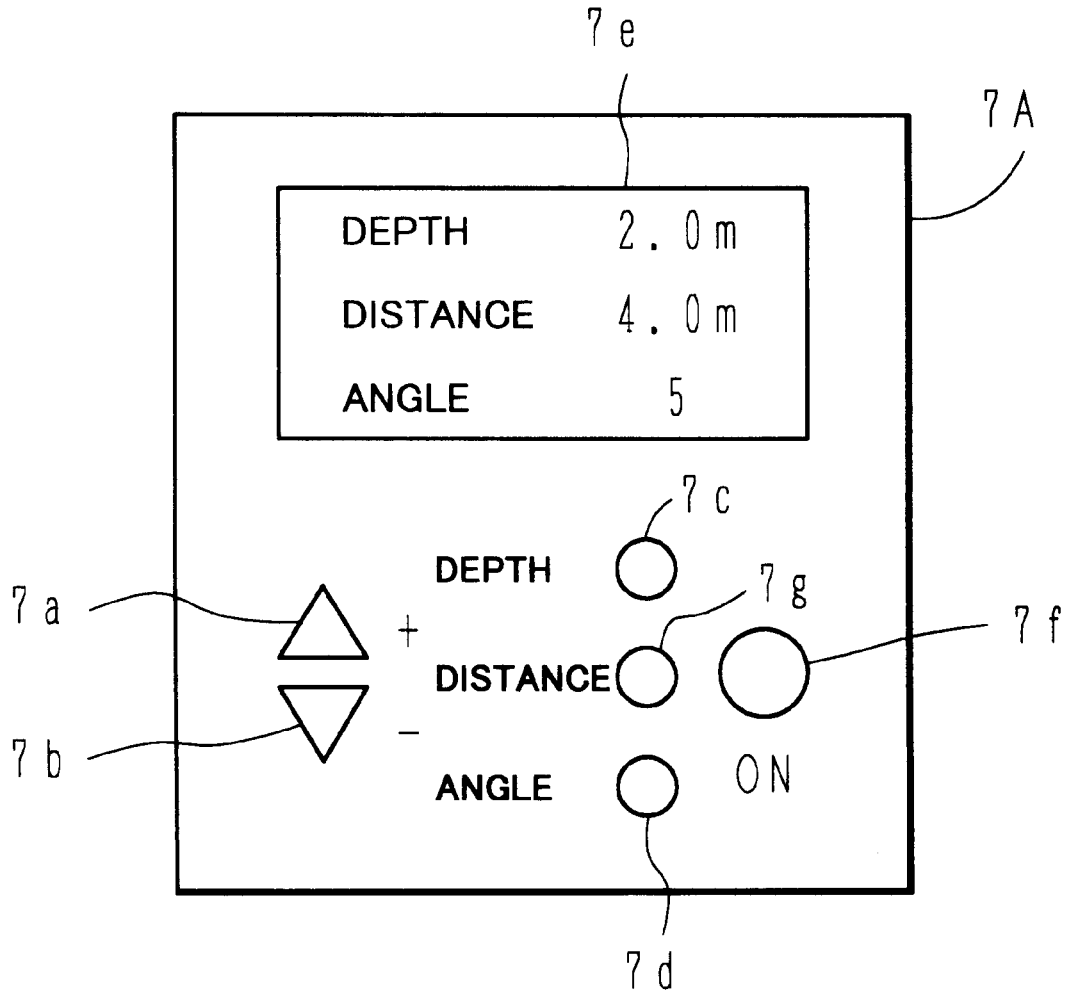
FIG. 13 is a view illustrating a setting device used in the second embodiment.

In FIG. 12, a first excavation area setting portion 9*a* (see FIG. 8; corresponding to the first setting means 100 in FIG. 5) of this embodiment inputs and sets, through a setting device 7A shown in FIG. 13, a depth hr from the external reference 80 to a reference point P of the excavation area, a distance hrx from the body reference point O to the reference point P, and a tilting angle θr of the boundary of the excavation area. In this embodiment, therefore, the setting device 7A has selection buttons 7*c*, 7*g*, 7*d* for selectively inputting a depth hd from the ground surface to the reference point P of the excavation area, the distance hrx from the body reference point O to the reference point P, and the tilting angle θr of the boundary of the excavation area.

Figure 14:
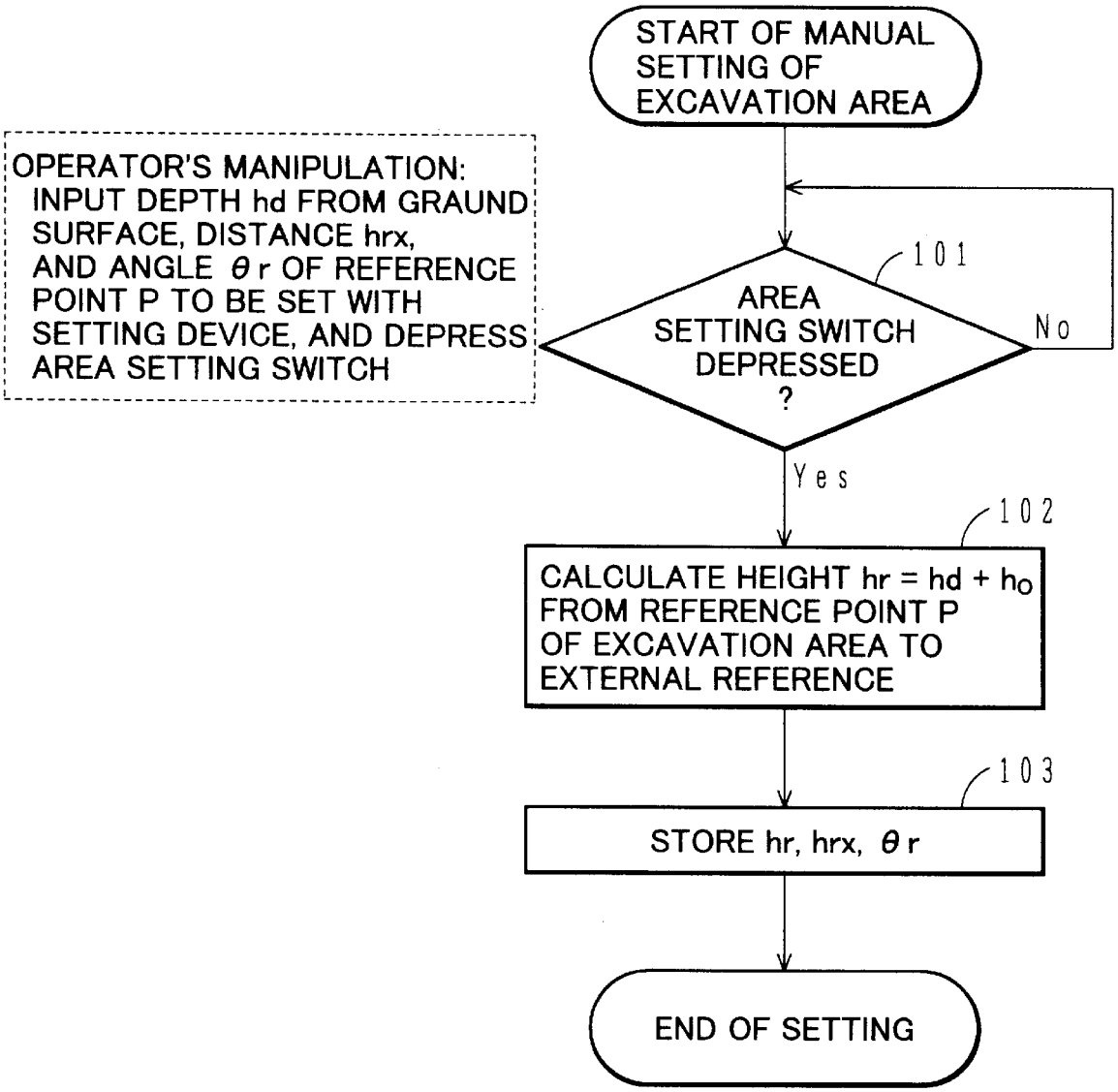
FIG. 14 is a flowchart showing a process flow of a first setting means in the excavation area setting system of the second embodiment.

FIG. 14 shows a process flow in the first excavation area setting portion 9*a*. When the operator inputs the depth hd, the distance hrx and the angle θr, the control unit confirms in step 101 whether the area setting switch 7*f* is depressed or not, and calculates in step 102 the depth hr from the external reference 80 to a reference point P of the excavation area in accordance with the above formula (1), respectively, as with the foregoing embodiment. The depth hr, the distance hrx and the angle θr are then stored in step 103.

Figure 15:
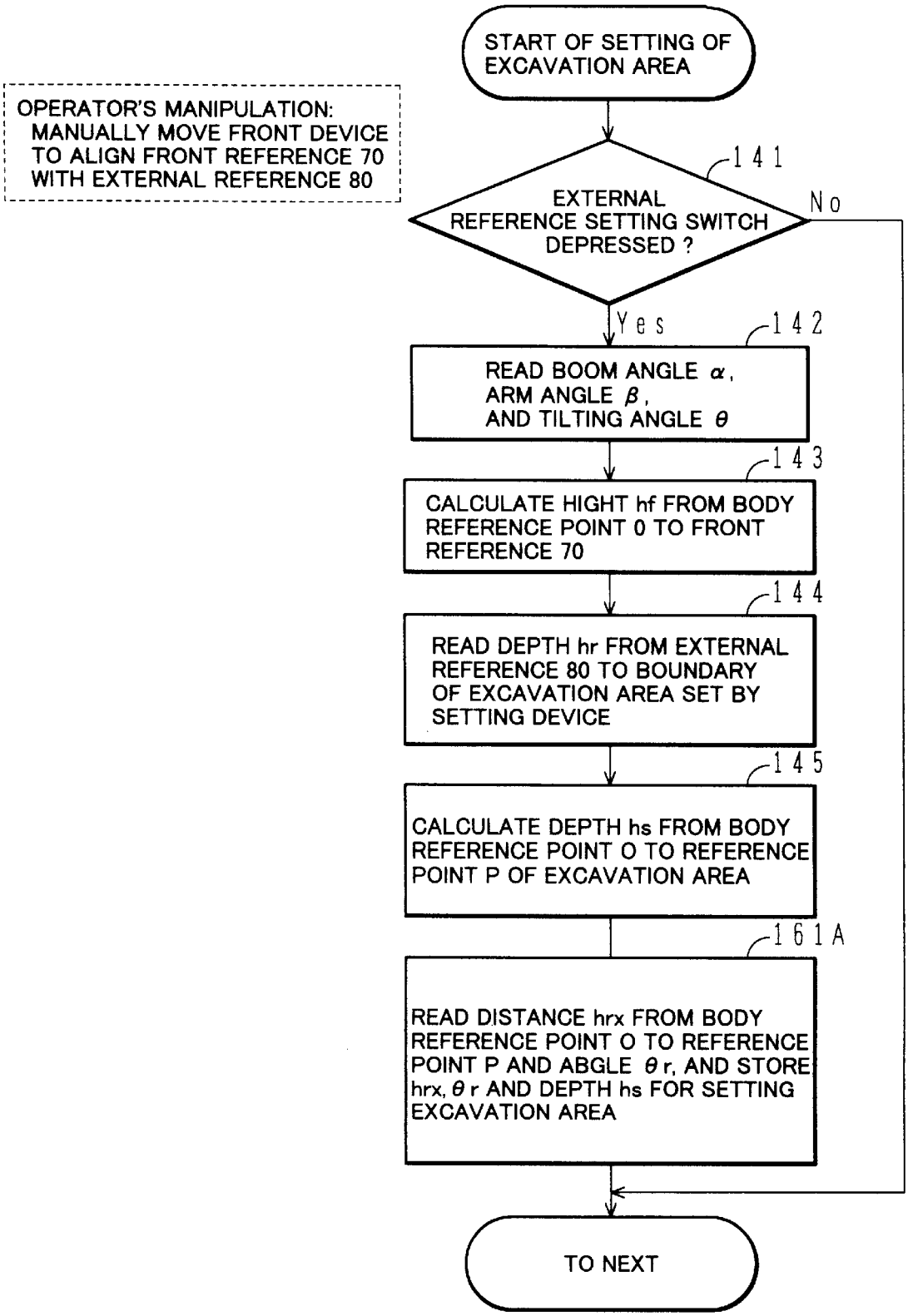
FIG. 15 is a flowchart showing a process flow of a second calculating means and a second setting means in the excavation area setting system of the second embodiment.

Also, in a second excavation area setting portion 9*n* (see FIG. 8; corresponding to the second setting means 160 in FIG. 5), the control unit sets an excavation area on the basis of the body as shown in FIG. 12 by making the front reference 70 aligned with the outer reference 80 and calculating a depth hs from the body reference point O to the reference point P of the excavation area when the area setting switch 71 is depressed, through steps 141–145 of a process flow for the excavation area setting shown in FIG. 15 as with the foregoing embodiment, and then reading the distance hrx and the angle or and further storing the depth hs and the read values in step 161A.

With this embodiment, similar advantages to those obtainable with the first embodiment can be provided when the area limiting excavation control is performed while moving the hydraulic excavator in the direction normal to the drawing sheet. Also, by performing the area limiting excavation control with a sloped excavation area set, such work as digging a trench for burying pipes for water supply and drainage can be easily implemented.

Figure 16:
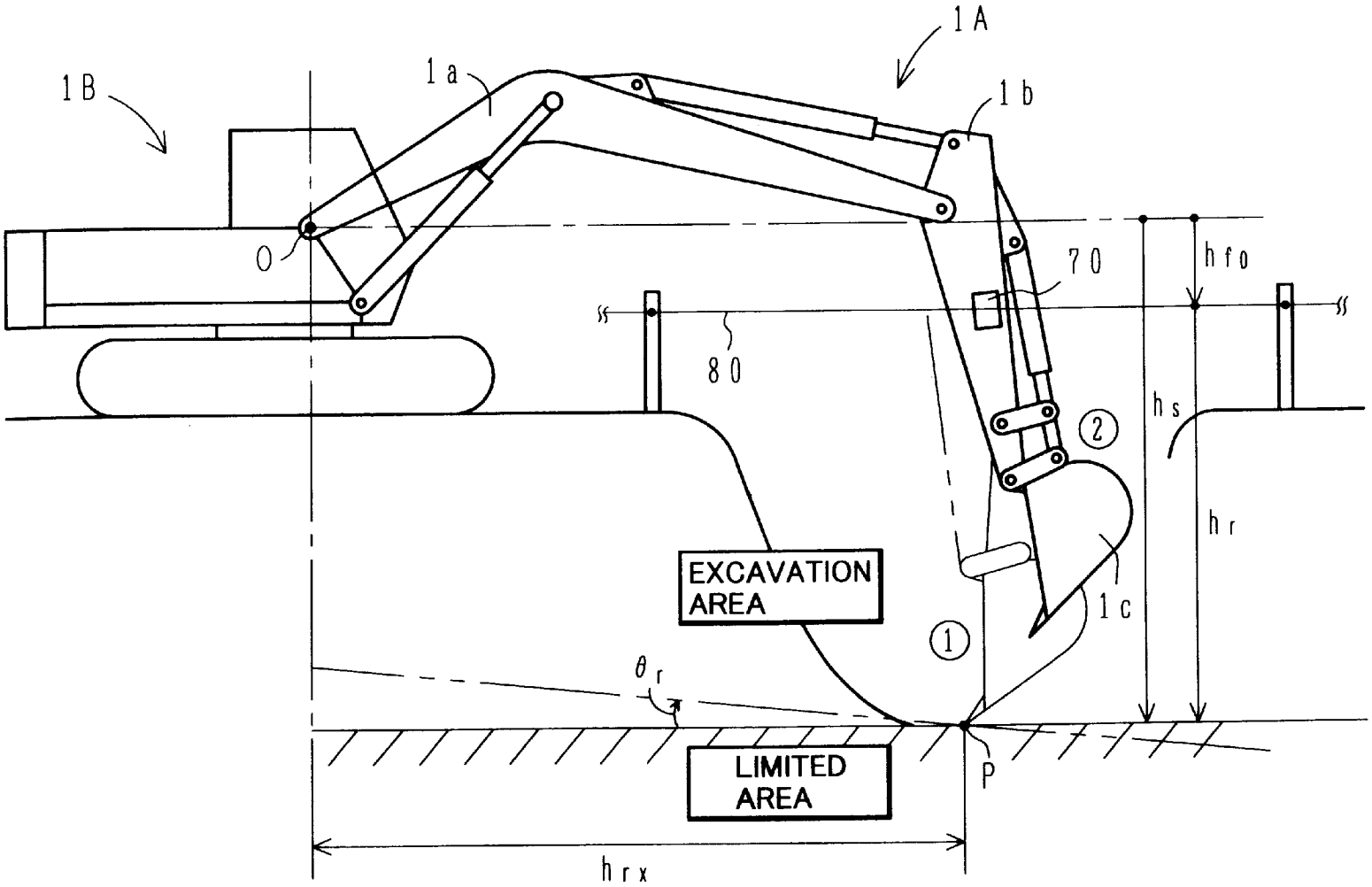
FIG. 16 is a view showing the relationship between an excavation area and an external reference when the excavation area is set by an excavation area setting system of a third embodiment.

A third embodiment of the present invention will be described with reference to FIGS. 16 to 18. This third embodiment intends to set the positional relationship between the external reference 80 and the excavation area by a direct teaching method, the setting being made by the first setting means 100 (see FIG. 5) in the above first and second embodiments.

More specifically, in the above first and second embodiments, the depth hr from the external reference 80 to the boundary of the excavation area or the distance hrx from the body reference point O to the reference point P of the excavation area is set in the first setting means 100 by using the up and down buttons 7*a*, 7*b* (see FIG. 3) of the setting device 7. In this third embodiment, the operator manipulates the control levers to move the tip of the bucket 1*c* to a position to be set, as indicated by two-dot-chain lines in FIG. 16, and sets the depth hr or the distance hr by direct teaching of that position.

Figure 17:
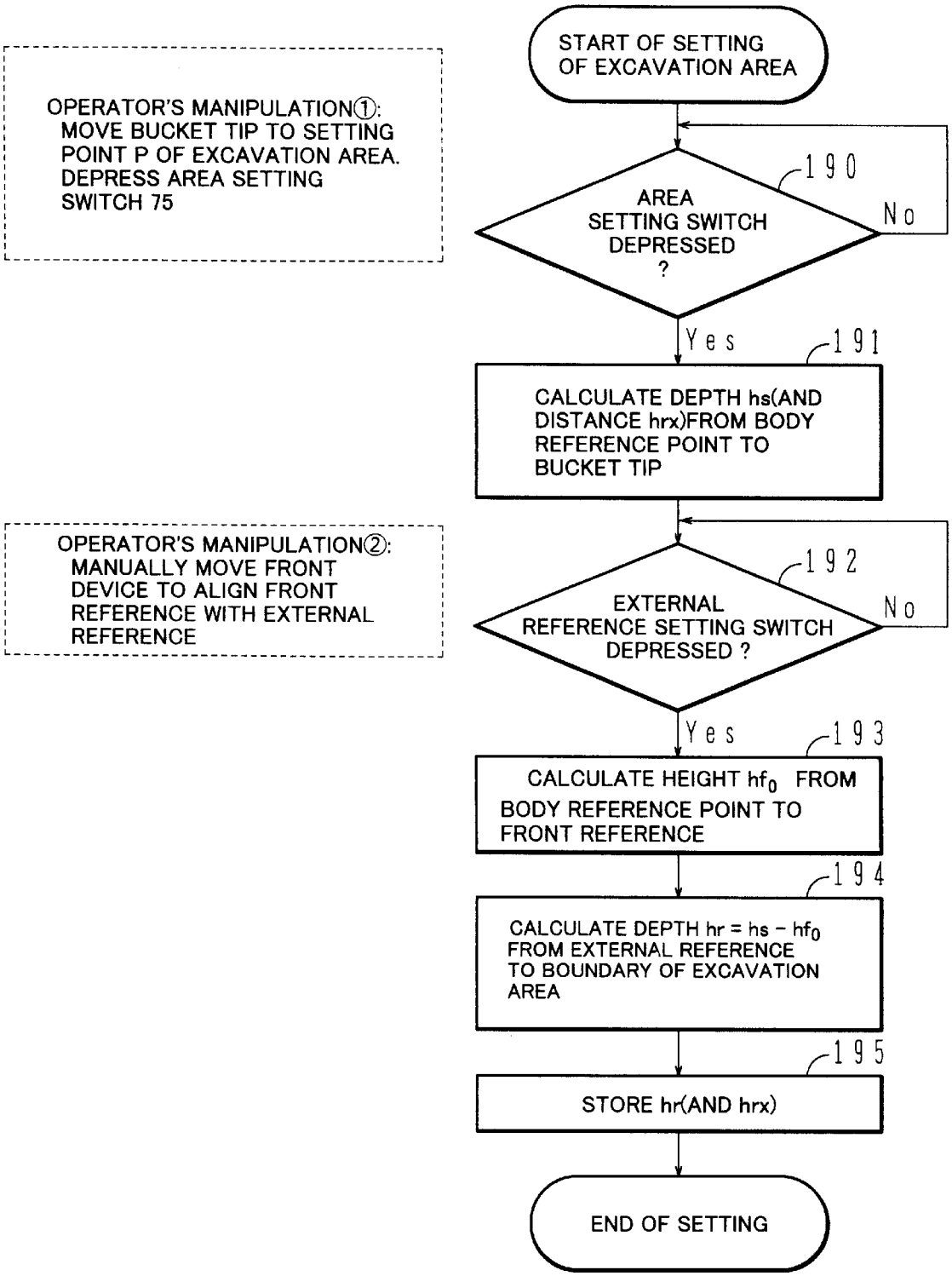
FIG. 17 is a flowchart showing a process flow of first setting means in the excavation area setting system of the third embodiment.
Figure 18:
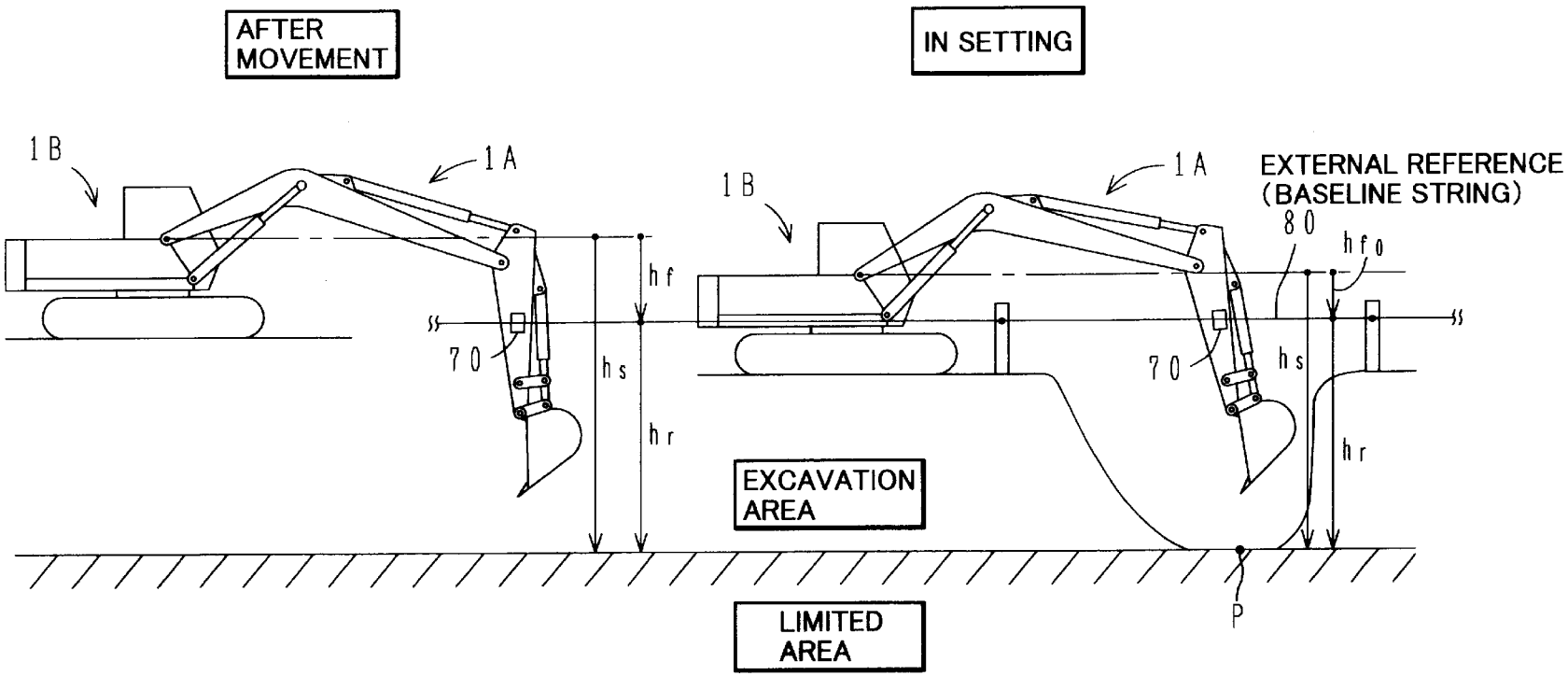
FIG. 18 is a view showing the relationship between setting data of the excavation area as initially set and after movement when the excavation area is set by the excavation area setting system of the third embodiment.

FIG. 17 shows a process flow of a method of setting the excavation area by direct teaching. In the drawing, blocks (1), (2) circumscribed by broken lines represent manipulations that must be performed by the operator of the hydraulic excavator.

First, as indicated in the block (1) of FIG. 17, the operator manipulates the control levers to move the front device 1A so that the tip of the bucket 1*c* comes to the setting point P of the excavation area. When the tip of the bucket 1*c* comes to the setting point P, the operator depresses the area setting switch 7*f* (see FIG. 3) of the setting device 7.

The control unit 9 (see FIG. 1), in step 190, determines whether the area setting switch 7*f* is depressed or not. If not depressed, the control unit 9 repeats step 190. If the area setting switch 7*f* is depressed, the control unit 9 goes to step 191.

In step 191, the control unit calculates the depth hs and the distance hrx from the body reference point O to the tip of the bucket 1*c* based on the posture of the front device 1A at that time.

Next, as indicated in the block (2) of FIG. 17, the operator manipulates the control levers again to move the front device 1A so that the front reference 70 is aligned with the external reference 80.

During the above manipulation, the control unit repetitively determines in step 192 whether the external reference setting switch 71 is depressed or not. If the external reference setting switch 71 is depressed by the operator upon the front reference 70 being aligned with the external reference 80, the control unit goes to step 193.

In step 193, the control unit 9 calculates the height hfo from the body reference point O to the front reference 70 based on the posture of the front device 1A at that time.

Next, in step 194, the depth hr from the external reference 80 to the boundary of the excavation area is calculated from te following formula:

$$hr=hs-hfo \tag{12}$$

Finally, in step 195, the setting is ended by storing the depth hr thus determined. When setting a sloped excavation area as with the second embodiment, the operator further inputs an angle θr by using the setting device 7. The control units stores the depth hr, the distance hrx and the angle θr, thus setting an excavation area as indicated by a two-dot-chain line in FIG. 16.

After the above-described setting of the excavation area on the basis of the external reference 80 is completed, the excavation control is started. The construction of this embodiment is the same as that of the first embodiment except the first setting means. In excavation work, the area limiting excavation control is performed by the first calculating means 120, the second calculating means 140 and the second setting means 160, shown in FIG. 5, using hr determined in step 194 as shown in FIG. 18 or hrx, hr and the angle θr determined in steps 191, 194. Whenever the body is moved and the operator depresses the external reference setting switch 71 upon the front reference 70 being aligned with the external reference 80, the control unit determines a modification value hf and updates the depth hs to carry out the area limiting excavation control while setting the excavation area on the basis of the body.

With this embodiment, since the excavation area is set by direct teaching, it is possible to precisely set a desired excavation area depending on work situations.

According to the present invention, even when the height of a hydraulic excavator is varied due to change in topography of the work site upon movement of the body, excavation can be always performed at a predetermined depth on the basis of the external reference. In the case of setting a horizontal excavation plane, for example, excavation can be performed along the horizontal plane even with the ground inclined, while moving the body.

Also, comparing the method of detecting reference light by a sensor mounted on the body, the excavation area setting system of the invention is less affected by errors such as manufacturing tolerances of the body or tolerances in accuracy and mounting of the sensors, etc., and excavation can be performed with a smaller difference from the set excavation area.

The lesser effect of the sensor errors, etc. also gives rise to an advantage below. Even when the excavation depth from the body is changed with movement of the body, it is possible to prevent change in the excavation depth between before and after the body height is varied, by making the external reference and the front reference aligned with each other in a position near the tip of the bucket actually acting on the ground for the excavation and updating the previous setting.

Since the front reference member can be formed by a small and simple member, such as an arrow mark of a steel plate, the movement of the body can be compensated without needing a large-sized and complicated sensor.

Further, the movement of the body can be compensated over a wide range because the front reference member is provided on the front device which is movable over a wide range.

In addition, since the excavation area is set on the basis of the body as with calculation of the target speed vector for the excavation control, the excavation area can be set in a manner matched with the excavation control in which calculation is executed on the basis of the body. As a result, the calculation to be executed during the excavation control is simplified and highly reliable area limiting excavation control can be achieved without causing a delay.

According to the present invention, since the calculation for setting the excavation area is executed by depressing the external reference setting switch when the front reference is aligned with the external reference, the calculation for setting the excavation area is not required during the excavation control and the amount of calculation to be executed during the excavation control is reduced, resulting in more highly reliable area limiting excavation control with more positive prevention of a delay.

According to the present invention, an excavation area having a horizontal plane at the boundary between it and the forbidden area can be set.

According to the present invention, by performing the area limiting excavation control with a sloped excavation area set, such work as digging a trench for burying pipes for water supply and drainage can be easily implemented.

According to the present invention, by effecting the setting operation of the first setting means with the setting device prior to starting work, no assistant operator is necessary to position the front device to the boundary of the excavation area at the start of work or whenever the body is travelled to a different place. Further, a time required for making the setting in accordance with an instruction from the assistant operator can be eliminated and a working time can be cut down.

Finally, according to the present invention, since the setting operation of the first setting means is made by direct teaching, it is possible to precisely set a desired excavation area depending on work situations.

We claim:

1. An excavation area setting system for area limiting excavation control in construction machines comprising a plurality of vertically pivotable front members making up a multi-articulated front device, and a body for supporting said front device, the excavation control being performed to calculate a target speed vector for control of said front device on the basis of said body, modify the target speed vector to limit a moving speed of said front device in the direction toward a boundary of a preset excavation area when said front device comes close to the boundary of the excavation area, and move said front device along the boundary of the excavation area, said excavation area setting system comprising:

an external reference member installed outside said construction machine and providing an external reference serving as a reference position for the excavation area;

a front reference member disposed on said front device and providing a front reference serving as a target used for aligning said front device with said external reference;

detecting means for detecting status variables in relation to a position and posture of said front device;

first calculating means for calculating the position and posture of said front device on the basis of said body from signals of said detecting means;

first setting means for setting the excavation area from a positional relationship with respect to said external reference;

second calculating means (9*m*, 140) for calculating a positional relationship between said body and said external reference based on information about the position and posture of said front device calculated by said first calculating means when said front reference is aligned with said external reference, and calculating a positional relationship between said body and the excavation area from the positional relationship between said body and said external reference and the positional relationship between said external reference and the excavation area set by said first setting means; and second setting means for setting an excavation area on the basis of said body from the positional relationship between said body and the excavation area calculated by said second calculating means.

2. An excavation area setting system for area limiting excavation control in construction machines according to claim 1, further comprising:

an external reference setting switch depressed when said front reference is aligned with said external reference;

wherein said second calculating means performs the calculation when said external reference setting switch is depressed.

3. An excavation area setting system for area limiting excavation control in construction machines according to claim 1, wherein said first setting means is means for setting a depth from said external reference to the boundary of the excavation area.

4. An excavation area setting system for area limiting excavation control in construction machines according to claim 1, wherein said first setting means is means for setting a depth from said external reference to a reference point of the excavation area, a distance from said body to the reference point, and a tilting angle of the boundary of the excavation area.

5. An excavation area setting system for area limiting excavation control in construction machines according to claim 1, wherein said first setting means is means for setting the positional relationship between said external reference and the excavation area based on data input from a setting device.

6. An excavation area setting system for area limiting excavation control in construction machines according to claim 1, wherein said first setting means includes means for calculating a position of a tip end of said front device taken when said front device is moved and the tip end of said front device comes to the boundary of the set area, based on information about the position and posture of said front device (1A) calculated by said first calculating means (9*b*, 120), means (192, 193) for calculating a position of said front reference taken when said front device is moved and said front reference is aligned with said external reference, based on the information about the position and posture of said front device calculated by said first calculating means, and means for calculating and storing a positional relationship between said external reference and the excavation area from the position of the tip end of said front device and the position of said front reference.

* * * * *

UNITED STATES PATENT AND TRADEMARK OFFICE

CERTIFICATE OF CORRECTION

PATENT NO. : 5,960,378

DATED : September 28, 1999

INVENTOR(S) : H. Watanabe, et. al.

It is certified that error appears in the above-identified patent and that said Letters Patent is hereby corrected as shown below: Title page, Item [22], delete "Filed: Jan. 16, 1997" and insert therefor --PCT Filed: Aug. 8, 1996--.

Delete "Related U.S. Application Data".

Delete "[63] Continuation of application No. PCT/JP96/02251, Aug. 8, 1996." and insert therefor:

--[86] PCT No.: PCT/JP96/02251

§ 371 Date: Jan. 16, 1997

§ 102(e) Date: Jan. 16, 1997--

--[87] PCT Pub. No.: WO97/07296

PCT Pub. Date: Feb. 27, 1997--

IN THE SPECIFICATION

Column 1, lines 5 and 6, delete "This application is a continuation of PCT JP96/02251 filed Aug. 8, 1997."

Signed and Sealed this

Twenty-seventh Day of June, 2000

*Attest:*

*Attesting Officer*

Q. TODD DICKINSON

*Director of Patents and Trademarks*